US007023462B2

(12) United States Patent
Fukuda

(10) Patent No.: US 7,023,462 B2
(45) Date of Patent: Apr. 4, 2006

(54) MULTIBEAM EXPOSURE DEVICE

(75) Inventor: Takeshi Fukuda, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/037,056

(22) Filed: Jan. 19, 2005

(65) Prior Publication Data

US 2005/0157161 A1 Jul. 21, 2005

(30) Foreign Application Priority Data

Jan. 19, 2004 (JP) ..... 2004-010730

(51) Int. Cl.
*G03G 7/20* (2006.01)
*B41J 2/447* (2006.01)
*B41J 2/46* (2006.01)

(52) U.S. Cl. ..... 347/236

(58) Field of Classification Search ..... 347/236, 347/246

See application file for complete search history.

(56) References Cited

U.S. PATENT DOCUMENTS 5,311,360 A 5/1994 Bloom et al.
6,201,559 B1 * 3/2001 Wada et al. ..... 347/236
6,251,550 B1 * 6/2001 Ishikawa ..... 430/22
6,388,694 B1 * 5/2002 Fujita ..... 347/236

FOREIGN PATENT DOCUMENTS

JP 61-52625 * 3/1986 ..... 359/217
JP 62-35323 * 2/1987 ..... 359/224
JP 2002-520840 A 7/2002
WO WO 00/03307 A1 1/2000

* cited by examiner

*Primary Examiner*—Huan Tran
(74) *Attorney, Agent, or Firm*—Sughrue Mion, PLLC

(57) ABSTRACT

A multibeam exposure device carrying out exposure processing by irradiating, onto an exposure surface of a photosensitive material, an exposure beam obtained by modulating a light beam, by a spatial light modulator and in accordance with an image to be exposed and formed, the multibeam exposure device having: an opening plate having an opening disposed on the exposure surface and blocking light which is other than an object of measurement of light quantity data at the spatial light modulator, the opening allowing passage of the exposure beam which corresponds to a pixel which is an object of measurement of light quantity data at the spatial light modulator; a feeding operation mechanism moving the opening plate such that the opening is moved in a direction intersecting a scanning direction at a time of scan-exposure; and a light-receiving element measuring a light quantity of the exposure beam which passes through the opening.

30 Claims, 16 Drawing Sheets

MULTIBEAM EXPOSURE DEVICE

CROSS-REFERENCE TO RELATED APPLICATION

This application claims priority under 35 USC 119 from Japanese Patent Application No. 2004-10730, the disclosure of which is incorporated by reference herein.

BACKGROUND OF THE INVENTION

1. Field of the Invention

The present invention relates to a multibeam exposure device structured so as to be able to measure light quantity data in order to improve exposure quality by adjustment of exposure quantities and shading adjustment which make a light quantity distribution uniform, when carrying out scan-exposure by using a multibeam emitted from a spatial light modulator provided at an exposure head.

2. Brief Description of the Related Art

In recent years, development has advanced of multibeam exposure devices which use spatial light modulators such as digital micromirror devices (DMDs) as pattern generators, and which carry out image exposure on a member-to-be-exposed, by a light beam modulated in accordance with image data.

A DMD is a mirror device in which, for example, a large number of micromirrors, at which the angles of the reflecting surfaces thereof are varied in accordance with control signals, are lined-up in two dimensions on a semiconductor substrate of silicon or the like. The angles of the reflecting surfaces of the micromirrors are varied by electrostatic forces due to electric charges accumulated in respective memory cells.

A multibeam exposure device using a conventional DMD uses an exposure head in which, for example, laser beams emitted from a light source are collimated by a lens system, the respective laser beams are reflected by the plural micromirrors of a DMD disposed substantially at the focal point position of the lens system, and the respective beams are emitted from plural beam exit openings.

Such a multibeam exposure device has been proposed which carries out image exposure at a high resolution by forming an image, by making the spot diameters small, on the recording surface of a photosensitive material (a member-to-be-exposed) by a lens system having an optical element such as a microlens array or the like which collects, at a single lens and for each one pixel, each beam emitted from the beam exit opening of the exposure head (see, for example, Japanese National Publication No. 2002-520840).

In such a multibeam exposure device, the respective micromirrors of the DMD are on/off controlled by an unillustrated control device on the basis of control signals generated in accordance with image data or the like, and the laser beams are modulated (deflected), and the modulated laser beams are irradiated onto the exposure surface (recording surface) and exposure is carried out.

A photosensitive material (a photoresist or the like) is disposed at the recording surface. This multibeam exposure device is structured so as to be able to carry out processing for exposing a detailed pattern on the photosensitive material in a short period of time, by modulating respective DMDs in accordance with image data, while relatively moving, with respect to the photosensitive material, the positions of the beam spots where the laser beams are irradiated and form images on the photosensitive material from plural recording heads.

In this multibeam exposure device, in accordance with the changes over time from before the start of exposure to during the exposure processing, the light quantity distribution of the laser light in the exposure-on state from the DMD set at the exposure head is measured, and it is necessary to carry out adjustment of the exposure quantities and shading adjustment for adjusting the light quantity distribution of the laser light to be uniform.

Thus, the following structure has been conceived of, for example: the driving of the DMD is controlled such that respective one columns of micromirrors along the scanning direction with respect to the photosensitive material are switched to the exposure-on state column-by-column and in order. The light quantities of the laser lights reflected at the DMD are detected by using a two-dimensional light detector such as a photodiode (PD) or a Charge Coupled Device (CCD) or the like, and the light quantity distribution of the DMD with respect to the direction orthogonal to the scanning direction is determined.

However, when the light quantity distribution of the DMD is determined as described above, the determination is affected by so-called stray light which is reflected by the large number of micromirrors of the DMD in off states and which is incident on the two-dimensional light detector. There is therefore the problem that it is difficult to measure accurate light quantity data such as the light quantity distribution or the like.

SUMMARY OF THE INVENTION

In view of the aforementioned, an object of the present invention is to newly provide a multibeam exposure device structured so as to be able to measure accurate light quantity data, such as a light quantity distribution or the like, in order to make possible shading adjustment and exposure quantity adjustment at the time of carrying out scan-exposure by a multibeam emitted from a spatial light modulator provided at an exposure head.

A first aspect of the present invention is to provide a multibeam exposure device carrying out exposure processing by irradiating, onto an exposure surface of a photosensitive material, an exposure beam obtained by modulating, by a spatial light modulator and in accordance with an image to be exposed and formed, a light beam which is emitted from a light source, the multibeam exposure device comprising: an opening plate disposed on the exposure surface and blocking light which is other than an object of measurement of light quantity data at the spatial light modulator, an opening being formed in the opening plate, the opening allowing passage of the exposure beam which corresponds to a pixel which is an object of measurement of light quantity data at the spatial light modulator; a feeding operation mechanism moving the opening plate such that the opening is moved in a direction intersecting a scanning direction at a time of scan-exposure; and a light-receiving element measuring a light quantity of the exposure beam which passes through the opening.

In accordance with the above-described structure, light which is other than the object of measurement is blocked-off by the opening plate, and the exposure beam, which is the object of measurement and which is modulated by the spatial light modulator, passes through the opening of the opening plate and is incident on the light-receiving element, and the light quantity data can be measured. Therefore, accurate measurement of light quantity data is made possible by excluding the effects of stray light or the like which is light other than the object of measurement. Further, while the opening of the opening plate is moved by the feeding operation mechanism in a direction intersecting the scanning direction at the time of scan-exposure, the light quantities of the exposure beams passing successively through the opening are measured at the light-receiving element. In this way, the light quantity distribution of the exposure beams irradiated onto the exposure surface from the spatial light modulator side is measured correctly, and shading adjustment and adjustment of the exposure quantities are possible.

In the first aspect, an optical wavelength filter may be disposed on an optical path between the spatial light modulator and the light-receiving element.

By using the optical wavelength filter, in accordance with the spectral sensitivity characteristic of the photosensitive material, or in accordance with the optical wavelength characteristic of the light beam emitted from the light source, the light quantity received at the light-receiving element is adjusted to a light quantity which is effective for actual exposure, and the light quantity of the exposure beam can be measured.

Further, the multibeam exposure device may be structured such that a width of the opening can be changed.

The width of the opening is changed in accordance with the optical paths of the exposure beams which are the object of measurement at the spatial light modulator. In this way, the exposure beams which are emitted from a predetermined column of the spatial light modulator can be measured in various states in accordance with the width of the predetermined column.

Further, the multibeam exposure device may be structured such that a length, along the scanning direction, of the opening can be changed.

By changing the width of the opening in accordance with the optical paths of the exposure beams which are the object of measurement at the spatial light modulator, measurement can be carried out in various states in accordance with the range of the exposure beams which are emitted from predetermined row(s) at predetermined column(s) of the spatial light modulator.

Moreover, the spatial light modulator may be a DMD.

The light quantity distribution and the light quantities of the exposure beams modulated by the DMD are accurately measured, and shading adjustment and adjustment of the exposure quantities are possible.

A second aspect of the present invention is to provide a multibeam exposure device scanning an exposure member in a given direction and forming an image on an exposure surface of the exposure member, the multibeam exposure device comprising: a light source emitting a light beam; an exposure head having a spatial light modulator which modulates the light beam into an exposure beam corresponding to an image to be formed, and which can selectively turn a plurality of pixels on and off; a light quantity data measuring mechanism measuring light quantity data of the exposure beam; and a feeding operation mechanism moving the light quantity data measuring mechanism in a direction intersecting a scanning direction with respect to the exposure surface, wherein the light quantity data measuring mechanism comprising: an opening plate disposed substantially flush with the exposure surface and blocking light which is other than an object of measurement of light quantity data at the spatial light modulator, an opening being formed in the opening plate, the opening allowing passage of the exposure beam which corresponds to a pixel which is an object of measurement of light quantity data at the spatial light modulator; a feeding operation mechanism moving the opening plate such that the opening is moved in a direction intersecting the scanning direction at a time of scan-exposure; and a light-receiving element measuring a light quantity of the exposure beam which passes through the opening.

A third aspect of the present invention is to provide an exposure method for carrying out exposure processing by irradiating, onto an exposure surface of a photosensitive material, an exposure beam obtained by modulating, by a spatial light modulator and in accordance with an image to be exposed and formed, a light beam which is emitted from a light source, the exposure method comprising: measuring a light quantity of the exposure beam which passes through an opening with a light-receiving element, the opening being provided in an opening plate disposed on the exposure surface and blocking light which is other than an object of measurement of light quantity data at the spatial light modulator, the opening allowing passage of the exposure beam which corresponds to a pixel which is an object of measurement of light quantity data at the spatial light modulator; adjusting exposure quantity and/or light quantity distribution on the exposure surface on the basis of the measured light quantity data; and carrying out exposure by irradiating, onto an exposure surface of a photosensitive material, an exposure beam obtained by modulating, by a spatial light modulator and in accordance with an image to be exposed and formed, a light beam which is emitted from a light source.

DETAILED DESCRIPTION OF THE INVENTION

A first embodiment relating to a multibeam exposure device of the present invention will be described with reference to FIGS. 1 through 14.

Structure of Exposure Device

Figure 1:
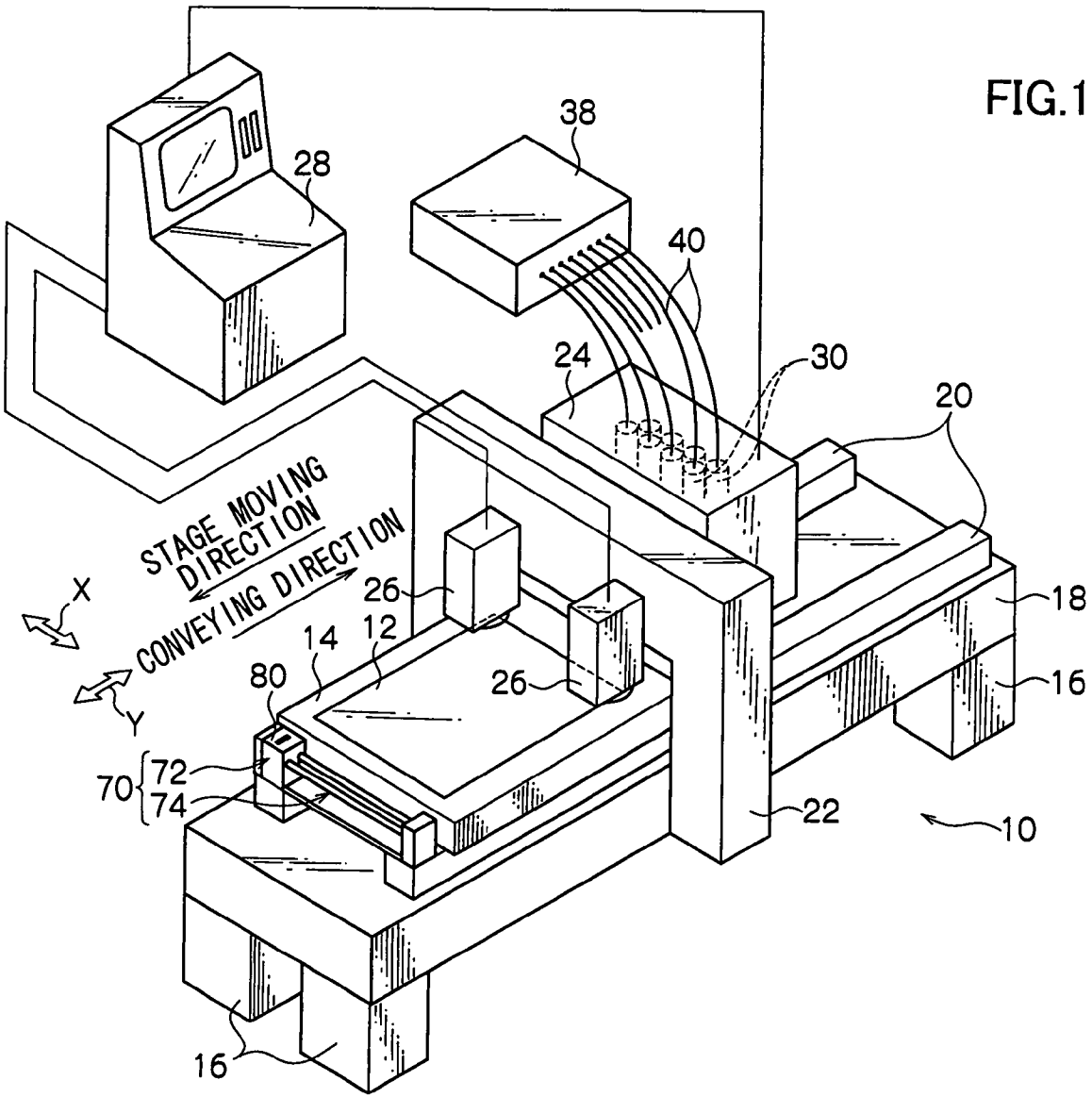
FIG. 1 is an overall schematic perspective view of an exposure device relating to a first embodiment of a multibeam exposure device of the present invention.

As shown in FIG. 1, an exposure device 10, which is structured as the multibeam exposure device relating to the first embodiment of the present invention, is a so-called flatbed-type exposure device. The exposure device 10 has a flat-plate-shaped stage 14 which sucks and holds at its surface a photosensitive material 12 which is a member-to-be-exposed which is the object of exposure. Two guides 20, which extend along a stage moving direction, are disposed on the top surface of a thick-plate-shaped setting stand 18 which is supported by four leg portions 16. The stage 14 is disposed such that the longitudinal direction thereof is oriented in the stage moving direction, and is supported by the guides 20 so as to be reciprocatingly movable. Note that an unillustrated driving device, for driving the stage 14 along the guides 20, is provided at the exposure device 10.

A U-shaped gate 22 is provided at the central portion of the setting stand 18 so as to straddle over the path of movement of the stage 14. The end portions of the gate 22 are fixed to the both side surfaces of the setting stand 18. A scanner 24 is provided at one side of the gate 22. A plurality of (e.g., two) sensors 26, which sense the leading end and the trailing end of the photosensitive material 12, are provided at the other side of the gate 22. The scanner 24 and the sensors 26 are mounted to the gate 22, and are fixed above the path of movement of the stage 14. The scanner 24 and the sensors 26 are connected to a controller 28, which serves as a control mechanism which controls the scanner 24 and the sensors 26.

Figure 2:
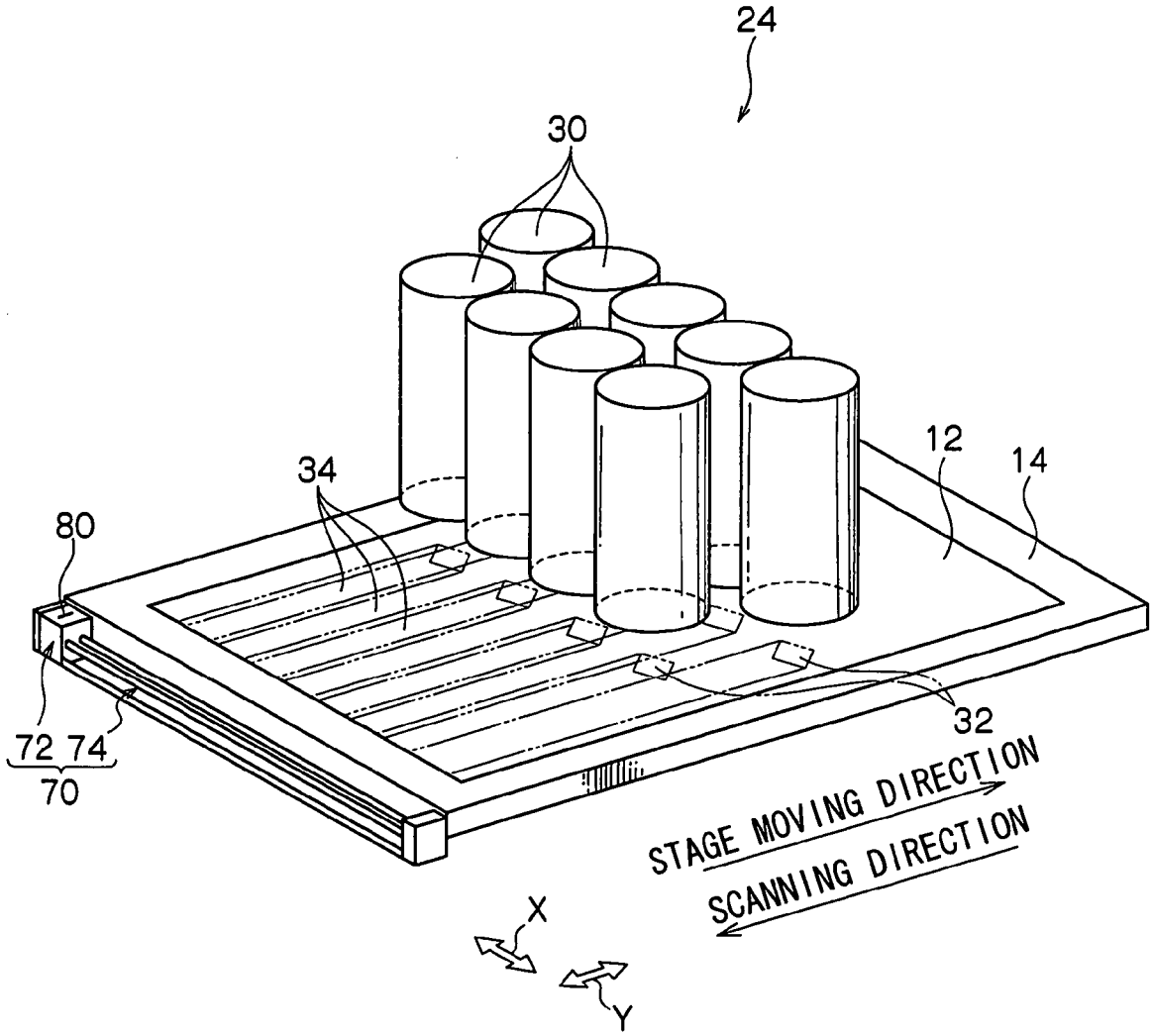
FIG. 2 is a perspective view showing a portion where exposure is carried out on a photosensitive material by respective exposure heads of a scanner provided at the multibeam exposure device of FIG. 1.
Figure 3:
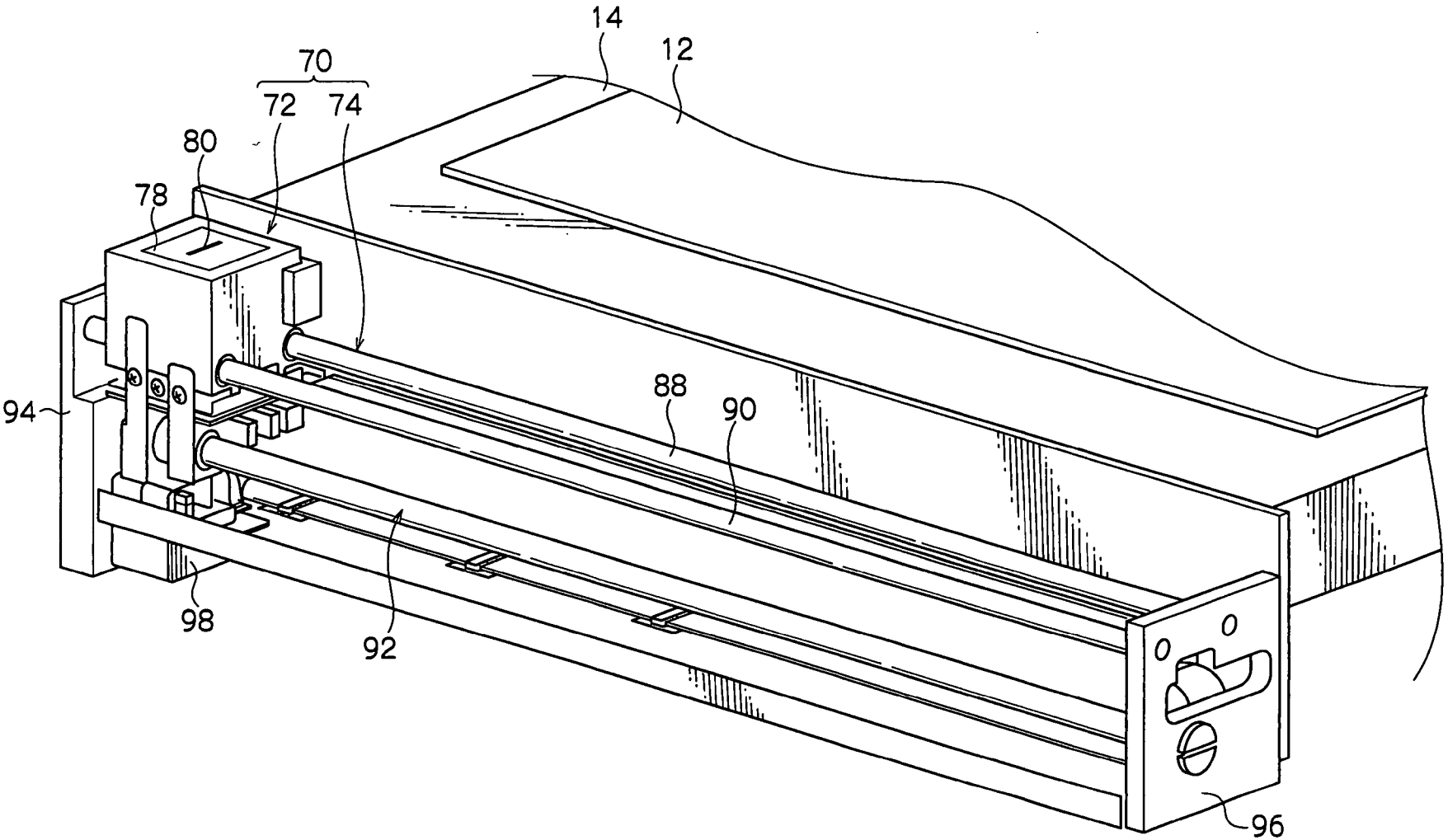
FIG. 3 is a perspective view showing a light quantity data measuring device mounted to a stage of the multibeam exposure device of FIG. 1.
Figure 4:
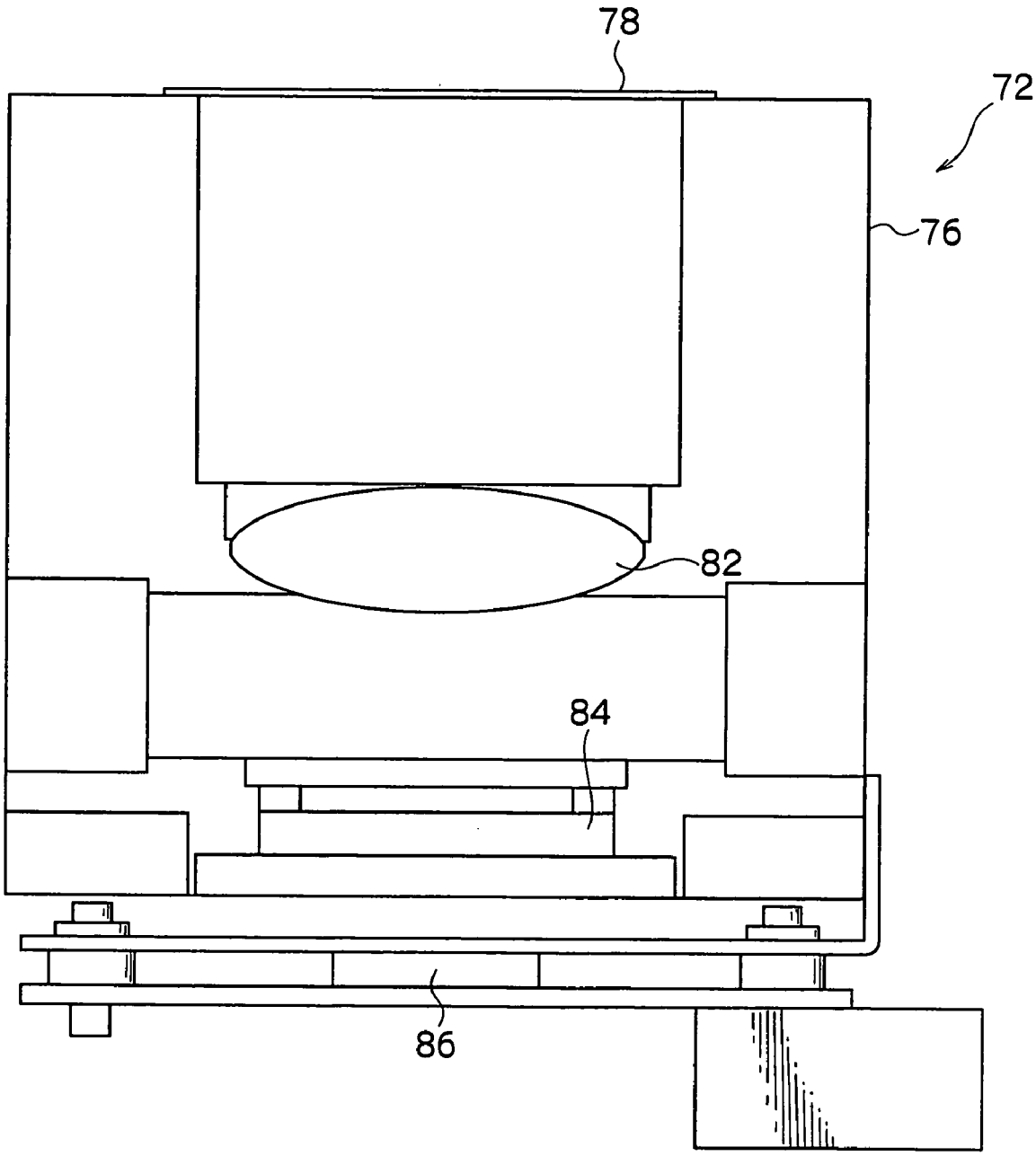
FIG. 4 is a schematic sectional view showing a light quantity data measurer of the light quantity data measuring device of FIG. 3.

As shown in FIG. 2, a plurality of (e.g., eight) exposure heads 30, which are arranged in a substantial matrix form of m lines and n columns (e.g., two lines and four columns), are disposed within the scanner 24.

An exposure area 32 of the exposure head 30 is in the shape of a rectangle whose short side runs along the scanning direction, for example. The exposure area 32 is inclined at a predetermined angle of inclination with respect to the scanning direction. In this case, accompanying the movement operation of the scan-exposure, a strip-shaped exposed region 34 is formed on the photosensitive material 12 by each of the exposure heads 30.

As shown in FIG. 2, the exposure heads 30 of each line, which are lined-up linearly, are disposed so as to be offset by a predetermined interval in the lined-up direction (a natural number multiple of the long side of the exposure area), so that the strip-shaped exposed regions 34 are lined-up, without intervals therebetween, in the direction orthogonal to the scanning direction. Therefore, for example, the portion which cannot be exposed between the exposure area 32 and the exposure area 32 of the first line can be exposed by the exposure area 32 of the second line.

Figure 5:
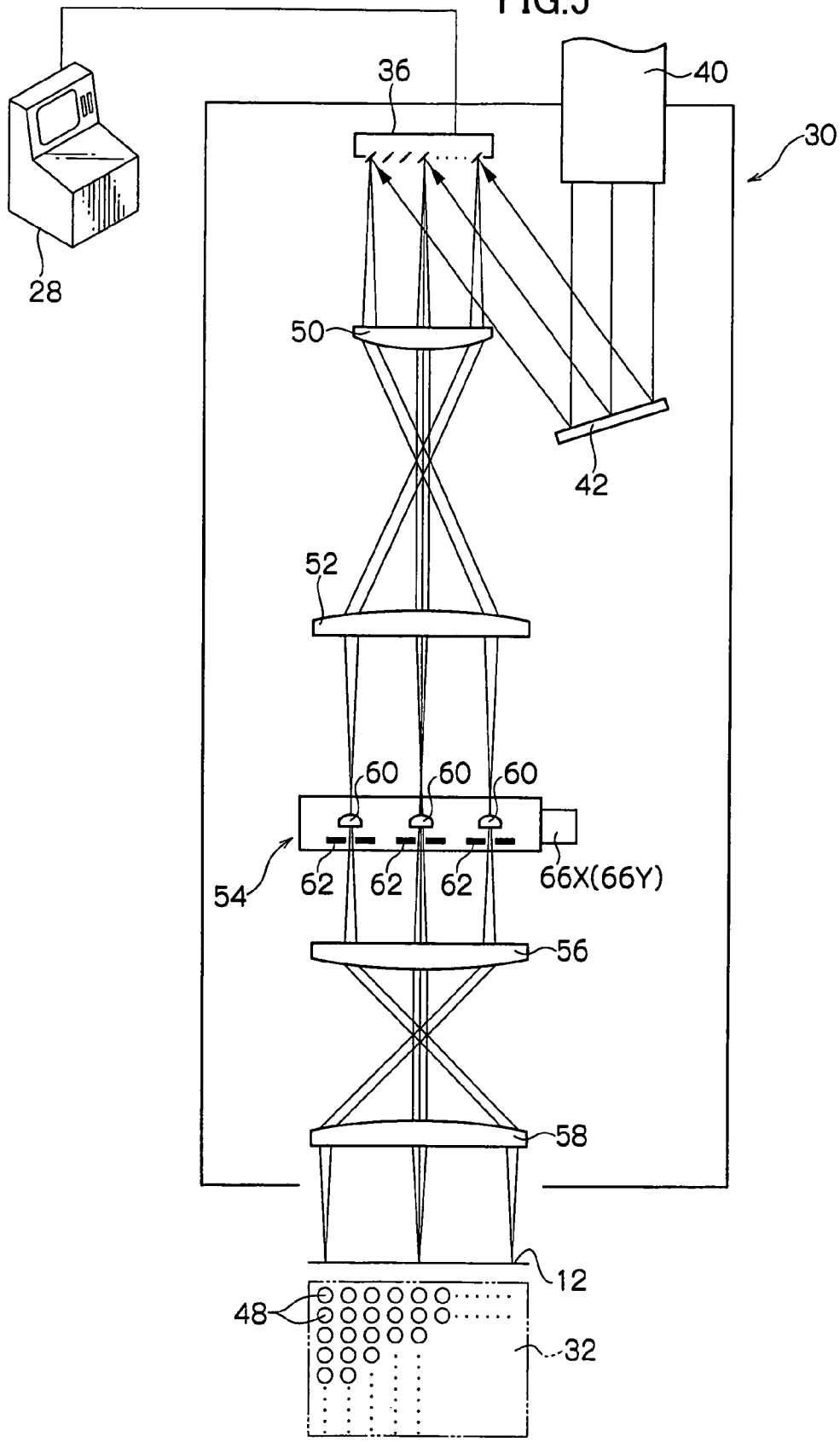
FIG. 5 is a schematic structural view of an optical system relating to the exposure head of the multibeam exposure device of FIG. 1.

As shown in FIG. 5, each of the exposure heads 30 has a digital micromirror device (DMD) 36 which serves as a spatial light modulator which modulates the light beams incident thereon on a pixel-by-pixel basis in accordance with image data. The DMD 36 is connected to the controller (control mechanism) 28 which has a data processing mechanism and a mirror driving control mechanism.

The data processing section of the controller 28 generates control signals for controlling the driving of the respective micromirrors within a region to be controlled of the DMD 36, for each exposure head 30 and on the basis of inputted image data. On the basis of the control signals generated by the data processing section, the mirror driving control mechanism, which serves as a DMD controller, controls the angles of the reflecting surfaces of the respective micromirrors at the DMD 36 of each exposure head 30.

As shown in FIG. 1, a bundled optical fiber 40 is connected to the light incident side of the DMD 36 of each exposure head 30. The bundled optical fibers 40 are pulled-out from an illuminating device 38 which is a light source unit emitting, as laser light, multibeams which extend in one direction and include the ultraviolet wavelength region. Note that the illuminating device 38 may be structured by an ultraviolet ray lamp (UV lamp), a xenon lamp, or the like which can be used as a general light source.

A plurality of multiplexing modules (not illustrated), which multiplex laser lights emitted from a plurality of semiconductor laser chips and input the multiplexed lights to optical fibers, are provided within the illuminating device 38. The optical fibers extending from the respective multiplexing modules are multiplex optical fibers which propagate multiplexed laser light. A plurality of the optical fibers are bundled into one and form the bundled optical fiber 40.

As shown in FIG. 5, a mirror 42 is disposed at the light incident side of the DMD 36 in each exposure device 30. The mirror 42 reflects, toward the DMD 36, the laser light emitted from the connected end portion of the bundled optical fiber 40 (or the light exiting from a UV lamp, a xenon lamp, or the like).

Figure 6:
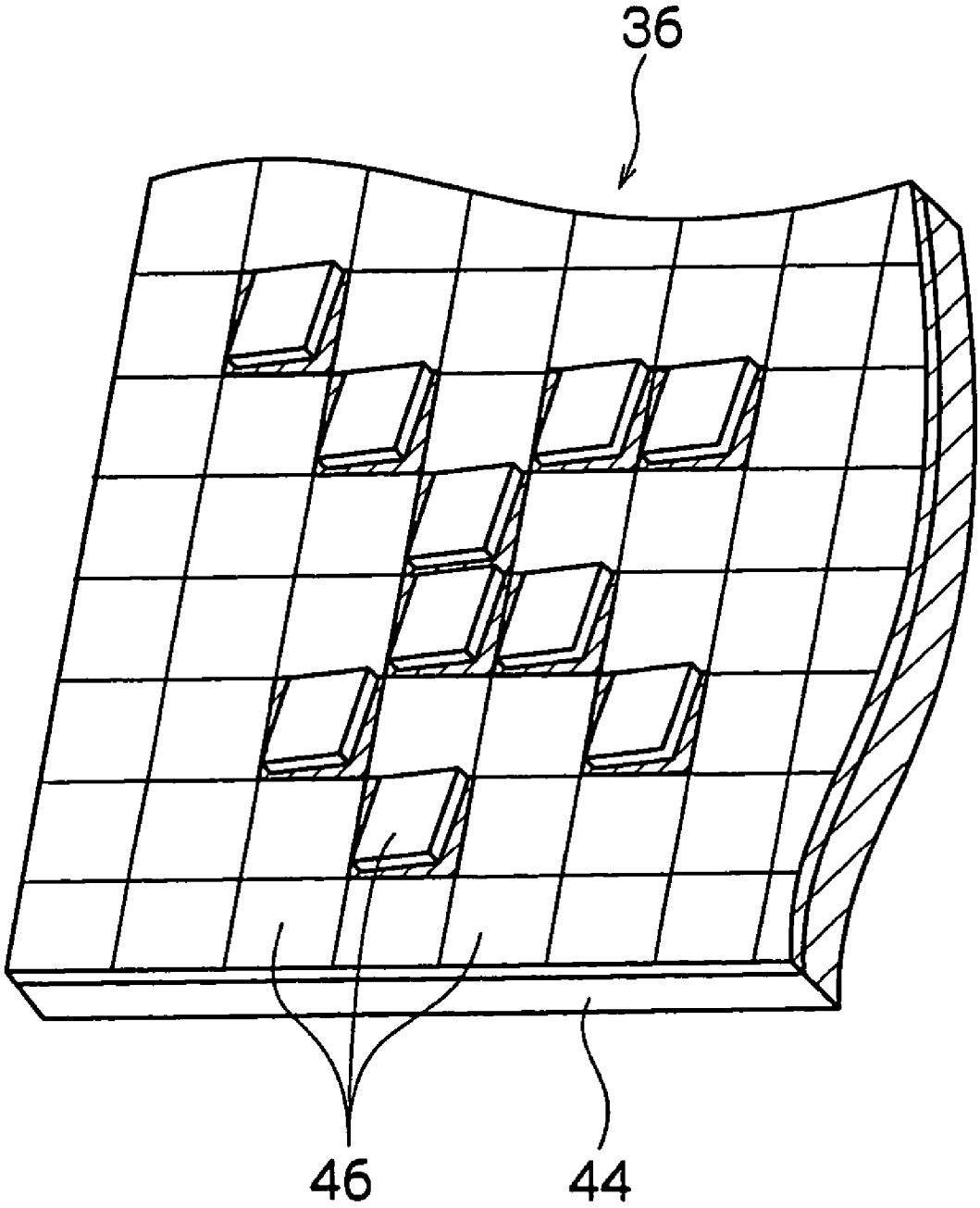
FIG. 6 is an enlarged view of main portions, showing the structure of a DMD used in the exposure device relating to the first embodiment of the present invention.

As shown in FIG. 6, in the DMD 36, micromirrors 46 are disposed on an SRAM cell 44 serving as a memory cell, so as to be supported by unillustrated supports. The DMD 36 is structured as a mirror device in which a large number (e.g., 600×800) of the extremely small mirrors which structure pixels are arranged in the form of a grid. The micromirror 46, which is supported at the support at the uppermost portion, is provided at each pixel. A material having high reflectivity, such as aluminum or the like, is deposited on the surface of the micromirror 46.

The SRAM cell 44 of a silicon gate CMOS, which is manufactured on a usual production line for semiconductor memories, is disposed directly beneath the micromirrors 46 via the supports including unillustrated hinges and yokes, so as to be structured monolithically overall.

Figure 7A:
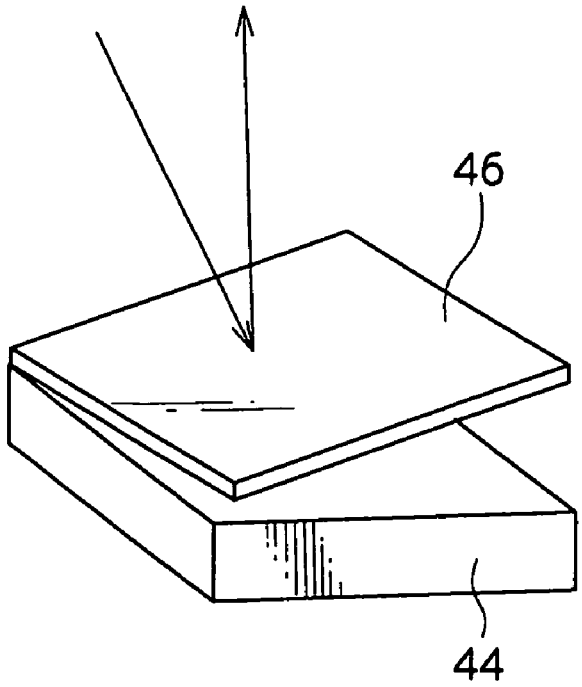
FIG. 7A is a diagram for explanation of operation of the DMD of FIG. 6.
Figure 7B:
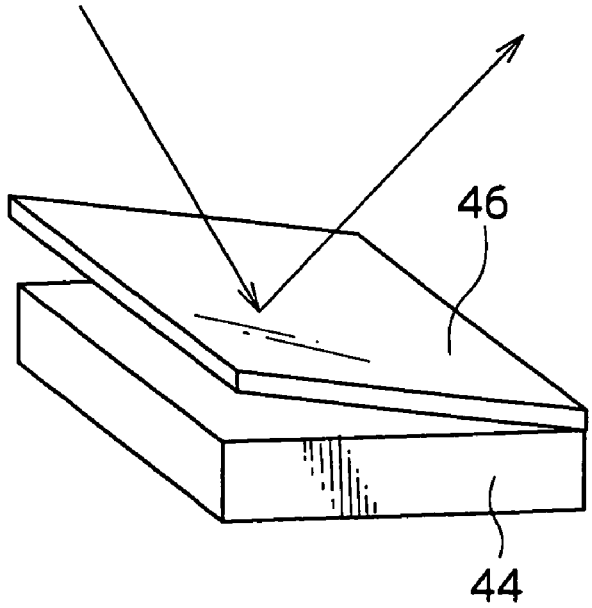
FIG. 7B is a diagram for explanation of operation of the DMD of FIG. 6.

When digital signals are written to the SRAM cell 44 of the DMD 36, the micromirrors 46, which are supported by the supports, are tilted, around diagonal lines, within a range of $\pm\alpha°$ (e.g., $\pm 10°$) with respect to the substrate on which the DMD 36 is disposed. FIG. 7A illustrates a state in which the micromirror 46 is tilted by $+\alpha°$ which is the on state. FIG. 7B illustrates a state in which the micromirror 46 is tilted by $-\alpha°$ a which is the off state. Accordingly, by controlling, as shown in FIGS. 6, 7A and 7B, the inclinations of the micromirrors 46 at the respective pixels of the DMD 36 in accordance with the image signal, the light incident on the DMD 36 is reflected in the directions of tilting of the respective micromirrors 46.

In FIG. 6, a portion of the DMD 36 is enlarged, and an example of a state in which the micromirrors 46 are controlled to $+\alpha°$ and $-\alpha°$ is shown. The on/off control of the respective micromirrors 46 is carried out by the controller 28 which is connected to the DMD 36. For example, the light reflected by the micromirror 46 which is in the on state is modulated to an exposure state, and is incident on the projecting optical system (FIG. 5) provided at the light exiting side of the DMD 36. Further, the light reflected by the micromirror 46 which is in the off state is modulated to a non-exposure state, and is incident on a light absorbing body (not illustrated). Namely, the DMD 36 makes the exposure beams, which are generated by being modulated in accordance with the image to be exposed and formed, incident on the projecting optical system.

Figure 8B:
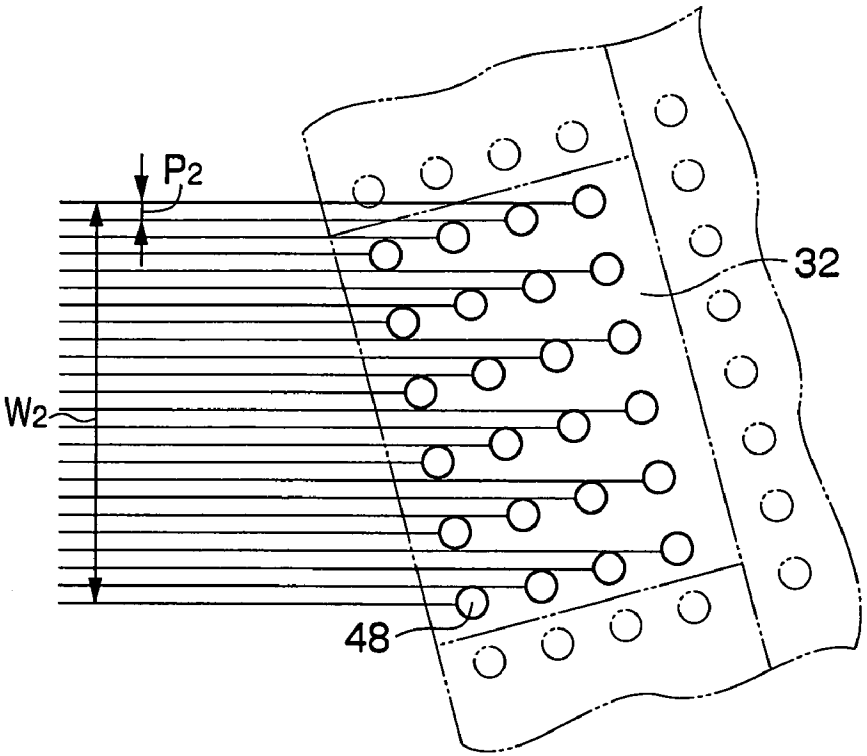
FIG. 8B is a plan view of main portions showing the loci of scanning of the exposure beams when the DMD of FIG. 8A is tilted.
Figure 8A:
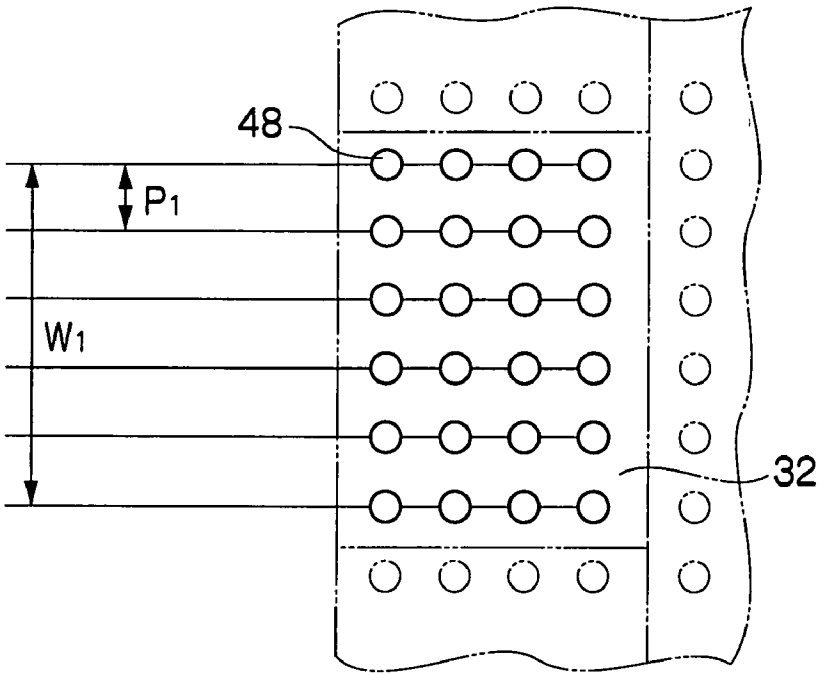
FIG. 8A is a plan view of main portions showing loci of scanning of reflected light images (exposure beams) by respective micromirrors when the DMD is not tilted, in the multibeam exposure device relating to the first embodiment of the present invention.

It is preferable that the DMD 36 be inclined slightly such that the short side direction thereof forms a predetermined angle $\theta$ (e.g., 0.1° to 0.5°) with the scanning direction. FIG. 8A shows the loci of scanning of reflected light images (exposure beams) 48 by the micromirrors in a case in which the DMD 36 is not inclined. FIG. 8B shows the loci of scanning of the exposure beams 48 in a case in which the DMD 36 is inclined.

In the DMD 36, a large number of (e.g., 600) micromirror columns, in each of which a large number (e.g., 800) of the micromirrors 46 is lined-up in the longitudinal direction (the line direction), is lined-up in the direction of the shorter side. As shown in FIG. 8B, by inclining the DMD 36, a pitch $P_2$ of the loci of scanning (the scan lines) of the exposure beams 48 by the micromirrors 46 is more narrow than a pitch $P_1$ of the scan lines in a case in which the DMD 36 is not inclined, and the resolution can be greatly improved. On the other hand, because the angle of inclination of the DMD 36 is extremely small, a scan width $W_2$ in a case in which the DMD 36 is inclined, and a scan width $W_1$ in a case in which the DMD 36 is not inclined, are substantially the same.

By inclining the DMD 36, substantially the same positions (dots) on the same scan line are exposed overlappingly (multiple-exposed) by different micromirror columns. By carrying out multiple exposure in this way, extremely small quantities of the exposure positions can be controlled, and extremely fine exposure can be realized. Further, the junctures between the plural exposure heads which are lined-up in the scanning direction can be connected without steps therebetween by controlling the exposure positions in extremely fine quantities.

Note that similar effects can be achieved if, instead of tilting the DMD 36, the respective micromirror columns are disposed in a staggered form so as to be offset by predetermined intervals in the direction orthogonal to the scanning direction.

Next, the projecting optical system (image forming optical system) provided at the light reflecting side of the DMD 36 of the exposure head 30 will be described. As shown in FIG. 5, the projecting optical system provided at the light reflecting side of the DMD 36 in each exposure head 30 is structured by optical members for exposure, which are lens systems 50, 52, a microlens array 54, and objective lens systems 56, 58, being disposed in that order from the DMD 36 toward the photosensitive material 12, in order to project the light source image onto the photosensitive material 12 which is at the position of the exposure surface disposed at the light reflecting side of the DMD 36.

The lens systems 50, 52 are structured as enlarging optical systems. By enlarging the cross-sectional area of the light beam bundle reflected by the DMD 36, the surface area, on the photosensitive material 12, of the exposure area 32 by the light beam bundle reflected by the DMD 36 is enlarged to a desired size.

As shown in FIG. 5, a plurality of microlenses 60 are formed integrally at the microlens array 54. The microlenses 60 correspond one-to-one to the micromirrors 46 of the DMD 36 which reflects the laser light irradiated from the illuminating device 38 through the optical fibers 40. The microlenses 60 are disposed on the optical axes of the laser beams which passed through the lens systems 50, 52.

The microlens array 54 is formed in the shape of a rectangular flat plate. Apertures 62 are provided integrally at the portions of the microlens array 54 where the respective microlenses 60 are formed. The apertures 62 are structured as aperture diaphragms which are disposed so as to correspond one-to-one to the respective microlenses 60.

As shown in FIG. 5, the objective lens systems 56, 58 are structured as, for example, non-magnifying optical systems. The photosensitive material 12 is disposed at the afterward focal point position of the objective lens systems 56, 58 (the position of the exposure surface). Note that, although the lens systems 50, 52 and the objective lens systems 56, 58 in the projecting optical system are each shown as one lens in FIG. 5, they may be combinations of plural lenses (e.g., a convex lens and a concave lens).

In the exposure head 30 which is structured as described above, due to disturbance and changes over time which arise during the operation of carrying out image formation by irradiating the laser beams emitting from the illuminating device 38 onto the surface of the photosensitive material 12, there are cases in which the light quantity distribution, in the direction orthogonal to the scanning direction, of the plural beams reflected by and emitting from the DMD 36 becomes non-uniform, and the exposure quantities of the respective portions on the photosensitive material 12, which are to be exposed at predetermined exposure quantity values, vary from these predetermined exposure quantity values.

Thus, in order to carry out adjustment of the exposure quantities and shading adjustment for making the light quantity distribution uniform, the exposure device 10 is provided with a light quantity data measuring mechanism for detecting the light quantity distribution and the exposure quantities of the plural beams emitting from the DMD 36.

A light quantity data measuring device 70 is provided as the light quantity data measuring mechanism in the exposure device 10 as shown in FIGS. 1 through 4. At the conveying direction upstream side of the stage 14, the light quantity data measuring device 70 measures the light quantity distribution and the exposure quantities of the exposure beams irradiated from the DMD 36, in the direction orthogonal to the scanning direction (or a direction intersecting the scanning direction at the time when scan-exposure is carried out). The light quantity data measuring device 70 has a light quantity data measurer 72, and a feeding operation mechanism 74 which supports the light quantity data measurer 72 so as to be able to be moved in the direction orthogonal to the scanning direction.

In the light quantity data measurer 72, a slit plate (opening plate) 78 is disposed at the top surface of a rectangular box shaped housing 76. A slit 80 (e.g., an opening of a width of 1 mm and a length of 20 mm), which is a through-groove of a predetermined configuration, is formed in the slit plate 78.

Within the housing 76 of the light quantity data measurer 72, a collecting lens 82 is disposed at a position which is directly beneath the slit 80 (opening) of the slit plate 78 and which is on the optical paths of the light beams incident from the slit 80 (opening) of the slit plate 78. Further, an optical wavelength filter 84 is disposed directly beneath the collecting lens 82 as needed, and a light-receiving element 86 is disposed directly beneath the optical wavelength filter 84. Note that the optical wavelength filter 84 may be disposed at an arbitrary place on the optical paths between the DMD 36 and the light-receiving element 86.

The light-receiving element 86 can be structured by a two-dimensional photodetector which is commercially available and widely used in general, such as a photodiode (PD) or a Charge Coupled Device (CCD) or the like. The optical wavelength filter 84 is used in order to make the spectral sensitivity characteristics of the photodiode match the spectral sensitivity characteristic of the photosensitive material 12, or is used to pass through the only optical wavelength characteristic of the light beams irradiated from the illuminating device 38 which is the light source.

In the light quantity data measurer 72 having the above-described structure, the light beams transmitted through the slit 80 are incident on the collecting lens 82, and, on the optical paths collected at the collecting lens 82, are incident on the optical wavelength filter 84. Light beams of predetermined wavelengths pass through the optical wavelength filter 84, and are collected and received on the light-receiving element 86. The light-receiving element 86 transmits, to the controller 82, measured values of the received light quantities.

Note that the light quantity data measurer 72 is disposed in a state in which the surface of the slit plate 78 coincides with the position of the exposure surface of the photosensitive material 12 set on the stage 14, i.e., in a state of being flush with the position of the exposure surface of the photosensitive material 12. When the slit plate 78 of the light quantity data measurer 72 is disposed so as to substantially coincide with the exposure surface of the photosensitive material 12 in this way, light quantity data, which relates to the light quantity distribution and the exposure quantities in the direction orthogonal to the scanning direction of the exposure beams emitted from the DMD 36, can be measured in a state which approximates and hardly changes at all from the state at the time when exposure processing is actually carried out on the photosensitive material 12.

The feeding operation mechanism 74, which supports the light quantity data measurer 72 so as to be able to be moved in the direction orthogonal to the scanning direction, has a pair of guide rails 88, 90 and a feeding mechanism 92, which span between supporting plates 94, 96 which are fixed so as to project out from ends of the edge portions at the conveying direction upstream side at the stage 14.

The light quantity data measurer 72 is mounted to the pair of guide rails 88, 90 such that the surface of the slit plate 78 coincides with the position of the exposure surface, and such that the light quantity data measurer 72 is freely slidable in parallel in a state in which the longitudinal direction of the slit 80 formed in the slit plate 78 is directed in a direction along the scanning direction.

The feeding mechanism 92 can be structured by, for example, a screw-feed mechanism. Due to a screw shaft being controlled so as to be driven to rotate by a feed motor 98, the light quantity data measurer 72, which is fixed to a moved screw part screwed on the screw shaft, is fed precisely by the desired feed amount in the direction orthogonal to the scanning direction, and can be fed at a constant, accurate feeding speed. Note that the feeding mechanism 92 may be structured by another accurate feeding mechanism which is generally used.

Next, description will be given of the procedures at the time when carrying out adjustment of the exposure quantities and shading adjustment for making the light quantity distribution of the exposure beams exiting from the DMD 36 uniform.

When the light quantity distribution and the exposure quantities are to be measured by the light quantity data measuring mechanism in the exposure device 10, from the first column of the DMD 36 which is the object of measurement at the exposure device 10 (e.g., the first column which is positioned at the initial position side of the light quantity data measurer 72 in the direction orthogonal to the scanning direction of the DMD 36, which corresponds to the left side in FIG. 1) to the final column, the respective columns are lit in succession by the control of the controller 28.

Before starting control with respect to the DMD 36, the controller 28 carries out control to drive the feeding operation mechanism 74 and move and position the light quantity data measurer 72 at the initial position, so that the central portion of the slit 80 corresponds to a predetermined position on the exposure surface which is irradiated by the exposure beams when the micromirrors 46 of the first column of the DMD 36 are turned on (lit) and the other micromirrors 46 are all off. Note that the position information of the scanning region exposed by the first column of the predetermined DMD 36 can be determined by using information which is held in advance as information used when the controller 28 controls the DMD 36 in order to form an image on the photosensitive material 12.

When the controller 28 has moved the light quantity data measurer 72 to the initial position and preparations have been completed, the controller 28 starts the operation of measuring the light quantity data. The controller 28 turns on only the group of micromirrors 46 of the first column of the DMD 36 which is the object of measurement, and measures the exposure quantities of the scan region corresponding only to this group of micromirrors 46 of the first column. Next, the controller 28 turns on only the group of micromirrors 46 of the second column of the DMD 36. Together therewith, the controller 28 controls the driving of the feeding operation mechanism 74 and moves the light quantity data measurer 72 so that the scan region on the exposure surface, which is exposed by the group of micromirrors 46 of the second column of the DMD 36, is positioned at the central position of the slit 80. Then, the exposure quantities of the scan region corresponding to the group of micromirrors 46 of the second column are measured.

The controller 28 successively repeats the above-described series of control operations from the group of micromirrors 46 of the first column to the group of micromirrors 46 of the final column. In this way, the light quantity distribution and the exposure quantities of the single DMD 36, which is the object of measurement, are measured. The measured values of this light quantity data are stored in order to carry out adjustment of the exposure quantities and shading adjustment for making uniform the light quantity distribution of the exposure beams emitted from the DMD 36 which is the object of measurement.

Figure 9:
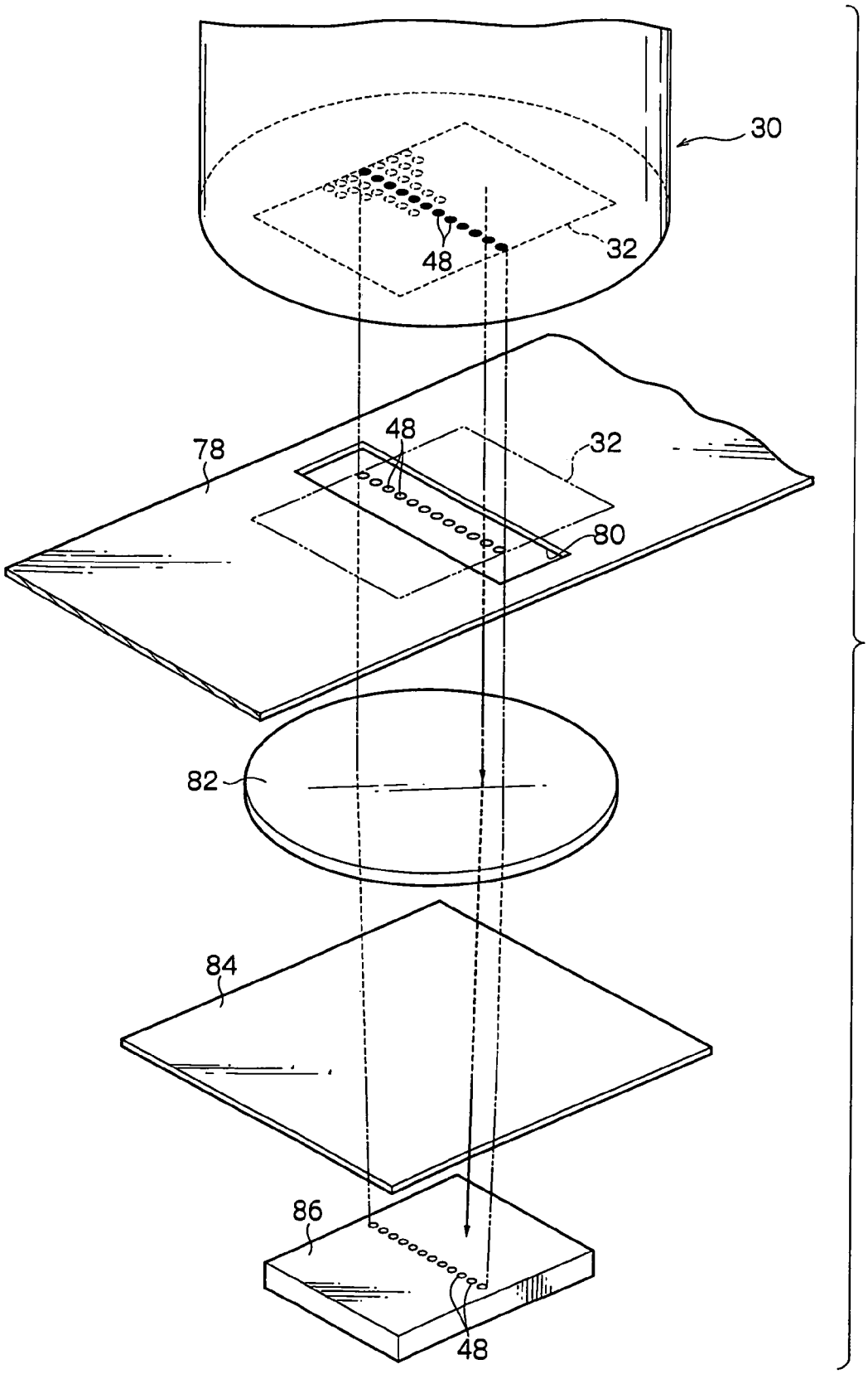
FIG. 9 is an explanatory diagram showing a state in which light quantities of pixels which are lit are detected by using a slit, in the multibeam exposure device of FIG. 1.

When measuring the light quantities of a group of micromirrors 46 of a given one column which corresponds to the exposure scanning direction by using the slit 80 in this way, as shown in FIG. 9, a predetermined plurality of exposure beams 48, which exit from the group of micromirrors 46 of the one column which are in an on state at the DMD 36, pass through the longitudinal direction central portion of the slit 80, and are collected at the collecting lens 82. The exposure beams 48 which pass through the optical wavelength filter 84 are received by the light-receiving element 86, and the light quantities thereof are measured.

At this time, stray light, which is irradiated from places other than the group of micromirrors 46 of the one column which is in the on state at the DMD 36, is reflected by the planar portion of the slit plate 78 other than the slit 80. Namely, the slit plate 78 blocks the light which is other than the object of measurement of the light quantity data (other exposure beams, or stray light, or the like). Therefore, stray light is not received by the light-receiving element, as shown by the three-dot chain line in FIG. 9.

When light quantity data is measured by using the slit plate 78 provided with the slit 80 in this way, it is possible to measure light quantity data of the scan region which is in line with the actual exposure state by a predetermined plurality of exposure beams emitted from a group of the micromirrors 46 of a predetermined column which are in the on state, while the effects of stray light are removed.

When the light quantity distribution of the DMD 36 changes along a gentle curve, instead of measuring with a group of the micromirrors 46 of one column (one line) of the DMD 36 being in an on state, the following may be carried out: groups of the micromirrors 46 of predetermined plural columns (plural lines) are simultaneously turned on, all of the exposure beams thereof pass through the slit 80, and the light quantity data relating to the DMD 36 is measured in the same way as described above. Moreover, in this case, it is possible to simultaneously turn on the micromirrors 46 of a single column or plural columns in a state of being scattered here and there in which open intervals of plural columns are provided, and all of these exposure beams pass through the slit 80, and the light quantity data relating to the DMD 36 is measured in the same way as described above. Note that the width of the slit 80 may be able to be changed and adjusted in accordance with the width on the optical paths of the exposure beams passing through the slit 80.

At the time when the light quantity data of a group of the micromirrors 46 of a single column or plural columns is measured, the light quantity data may be measured by grouping, in units of a single line or plural lines, the respective micromirrors 46 from the first line through the final line. In this way, it is possible to measure respective light quantity data of the respective micromirrors 46 of a predetermined row or rows of a predetermined column or columns, or to measure respective light quantity data of plural groups of micromirrors 46 of predetermined plural rows of predetermined plural columns.

When measuring the light quantity data corresponding to the respective micromirrors 46 of predetermined row(s) of predetermined column(s), it is possible to use a structure in which through holes, which allow passage of only the light beams which are emitted from the micromirrors 46 of the predetermined row(s) of the predetermined column(s), are formed in the slit plate 78, and measurement is carried out by moving this slit plate 78 in X and Y directions on the exposure surface shown in FIG. 1. Further, although not illustrated, a slit plate, in which is formed a slit in a direction orthogonal to the longitudinal direction of the slit 80 of the slit plate 78, may be superposed on the slit plate 78 so as to be movable, such that the region at which the light beams pass through the slit 80 can be changed and adjusted.

If the light quantities of the individual micromirrors 46 of the DMD 36 are measured in this way, adjustment of the exposure quantities and shading adjustment for making the light quantity distribution of the exposure beams emitted from the DMD 36 uniform can be carried out more precisely. In addition, because the light quantities of the individual exposure beams 48 are problematic in the case of a thermal-type photosensitive material, good shading adjustment is possible when the light quantities of the respective exposure beams are measured individually.

In contrast, when measuring the light quantities of a group of plural micromirrors 46 which have been grouped together at the DMD 36, or a group of plural micromirrors 46 which are scattered here and there, the work of measuring the light quantity data can be simplified and accelerated.

In the above-described measuring, it is preferable that measuring be carried out with the slit 80 of the slit plate 78 coinciding with the direction in which the columns of the micromirrors 46, which are the object of measuring, are directed. For example, it is preferable to make the longitudinal direction of the slit 80 coincide with the scan-exposure direction, or to make the longitudinal direction of the slit 80 coincide with the direction in which the DMD 36 is inclined (FIG. 8B), or, when multiple exposure is carried out for one pixel at the DMD 36 which is inclined, it is preferable to make the longitudinal direction of the slit 80 coincide with the direction of the column corresponding to the plural micromirrors 46 which are multiple-exposing the one pixel.

Figure 11:
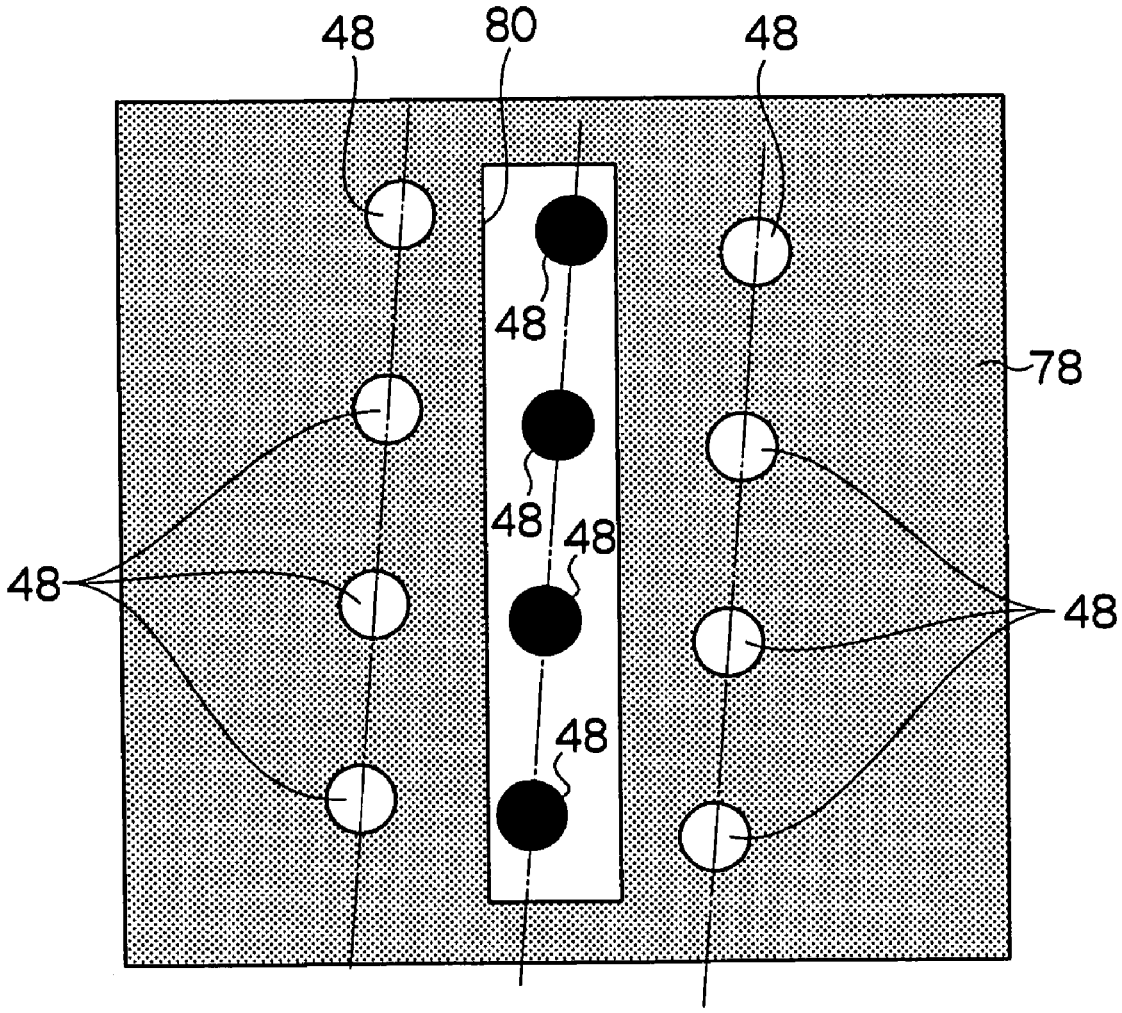
FIG. 11 is an explanatory diagram showing a summary of a state in which light quantities of pixels which are lit are detected by using the slit, in the multibeam exposure device of FIG. 1.

As shown in FIG. 11, when measuring light quantity data by using the slit 80, the width of the slit 80 may be set to be narrow so that only predetermined plural exposure beams 48, which are emitted from the group of one column of micromirrors 46 which is the object of measuring for example, can pass through the slit 80. Measuring can be carried out such that the exposure beams 48 emitted from the other micromirrors 46 of the DMD 36 are reflected by the slit plate 78, and are not received by the light-receiving element 86.

Figure 10:
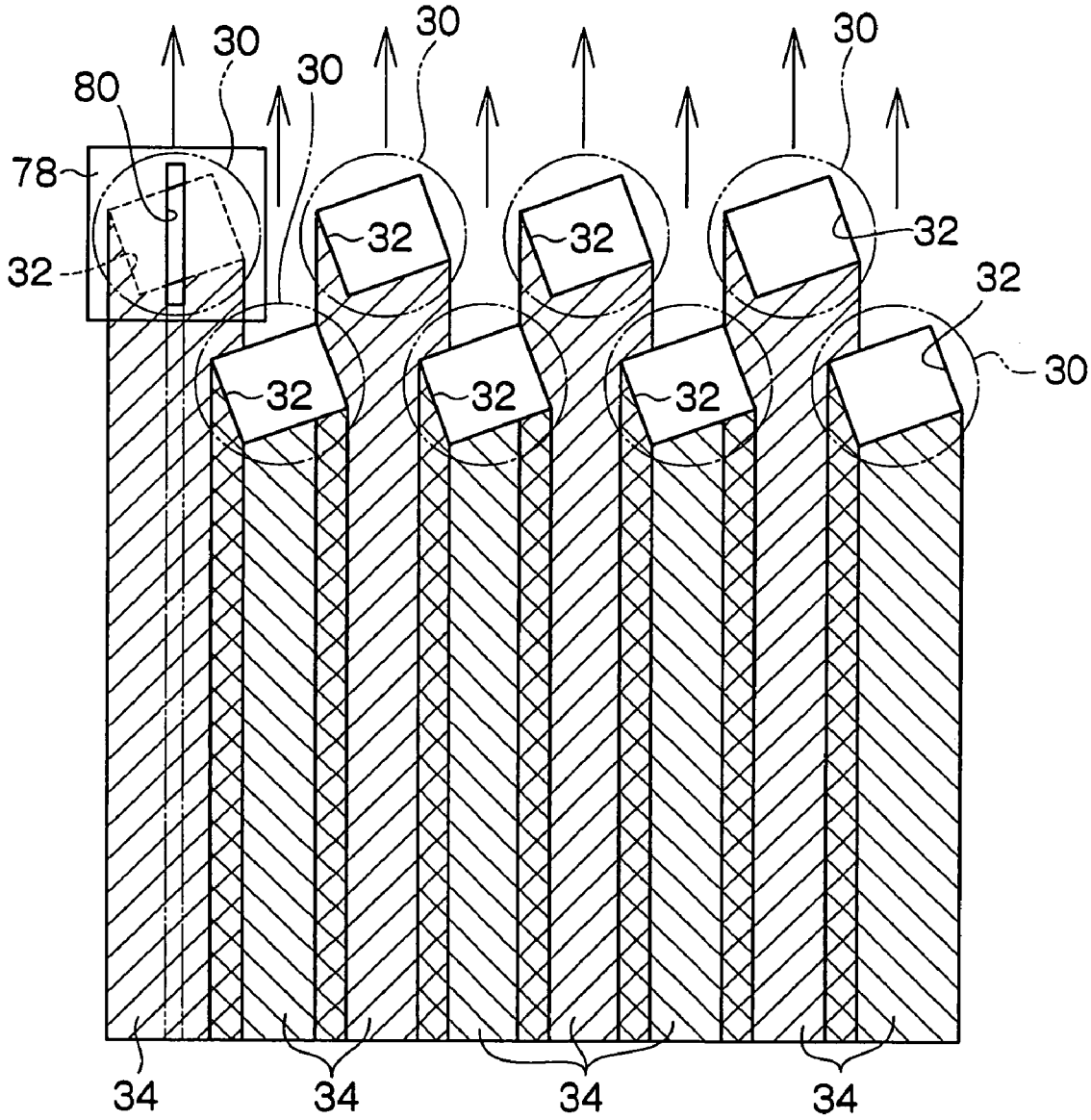
FIG. 10 is an explanatory diagram showing a state of detecting a light quantity distribution and exposure quantities by the light quantity data measuring device of FIG. 3.

Further, as shown in FIG. 10, in the exposure device 10, when the measuring of the light quantity data for, for example, the upper left DMD 36 in the figure is completed, the DMD 36 which is adjacent at the right at the upper side in the drawing is measured. Similarly, when measurement of the light quantity data of all of the DMDs 36 at the upper side is completed, the stage 14 is moved, the lower left DMD 36 in the drawing is moved to, and the light quantity data is measured. The DMD 36 adjacent at the right at the lower side in the drawing is moved to, and the light quantity data of all of the DMDs 36 of the lower side is measured.

Figure 12:
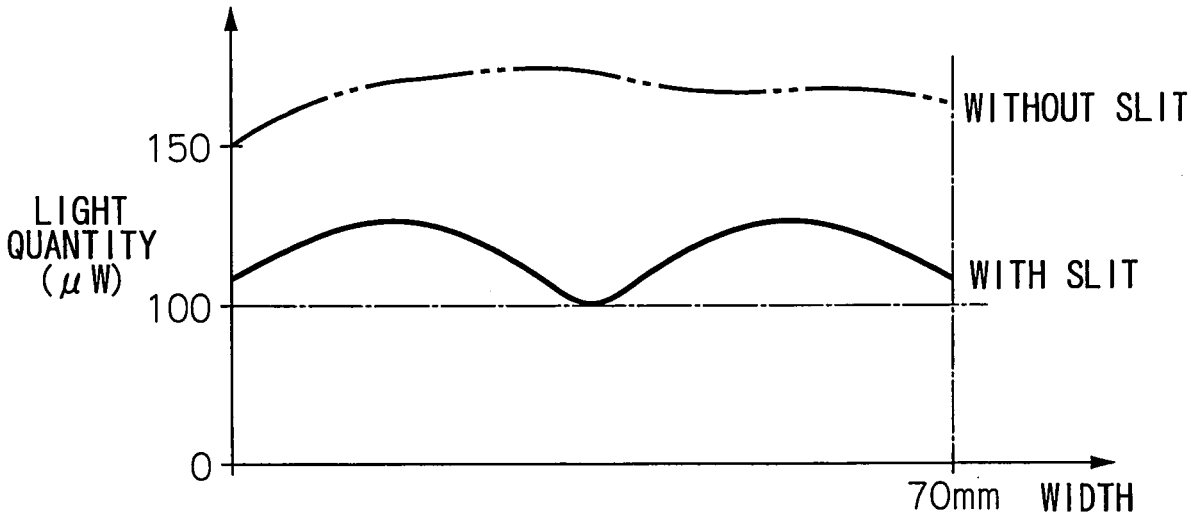
FIG. 12 is a graph showing an example of a light quantity distribution measured by the light quantity data measuring device of the multibeam exposure device relating to the first embodiment of the present invention.

In the exposure device 10, the light quantity distribution and the exposure quantities of the exposure beams emitted from the DMD 36 which were measured as described above, are detected as data as shown by the solid line (the line marked "with slit") in FIG. 12.

Due to the operation of the slit plate 78 and the slit 80, stray light is excluded from the light quantity data shown as an example by the solid line in FIG. 12. It can therefore be understood that there is an increase in accuracy of about 50%, as compared with a measuring mechanism in which the slit plate 78 is not provided and stray light is incident on the light-receiving element 86.

When uniform light quantity data in the light quantity distribution, such as shown as an example by the solid line in FIG. 12, is obtained in this way, adjustment of the exposure quantities and shading adjustment to make uniform the light quantity distribution of the exposure beams emitted from the DMD 36, are carried out.

In the adjustment of the exposure quantities and the shading adjustment for making uniform the light quantity distribution of the exposure beams emitted from the DMD 36, for example, correction can be carried out to make the light quantity distribution uniform so as to follow along the minimum line of the exposure quantities in the light quantity distribution. In this case, it is possible to utilize a means which, with respect to a pixel at which the exposure quantity is great, reduces the number of micromirrors 46 carrying out multiple exposure, or reduces the time period of the on state of the micromirror 46.

Figure 14:
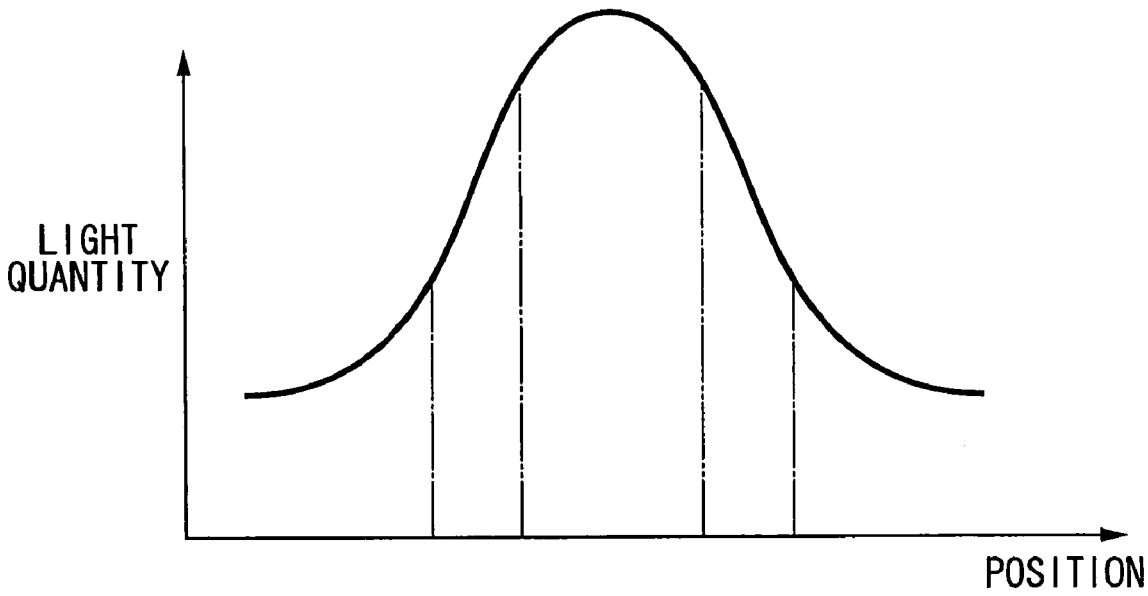
FIG. 14 is a graph showing an example of a characteristic of an exposure beam of the multibeam exposure device relating to the first embodiment of the present invention.

The state of the exposure beam with respect to each pixel is the state of a normal distribution such as shown in FIG. 14. The following may be carried out: the property that, when the exposure quantity is great, the exposure surface area of the pixel is large, and when the exposure quantity is low, the exposure surface area of the pixel is small, is utilized, and correction is carried out such that the image data, which corresponds to the pixel portion where the exposure quantity is great, is rewritten so as to become a small surface area, and the image data, which corresponds to the pixel portion where the exposure quantity is low, is rewritten so as become a large surface area. (For example, when forming the image of a line at a pixel portion where the exposure quantity is great, correction is carried out by rewriting the image data of that line to image data for making a thin line.)

It is preferable that the adjustment of the exposure quantities and the shading adjustment for making uniform the light quantity distribution of the exposure beams emitting from the DMD 36, be carried out not only for each DMD 36, but also that, at all of the DMDs 36 set at the scanner 24, adjustment be carried out so as to make the light quantity distributions uniform relatively.

In the exposure device 10, by using the optical wavelength filter 84 mounted in the light quantity data measurer 72, it is possible to carry out adjustment of the exposure quantities which corresponds to the spectral sensitivity characteristic of the photosensitive material 12, or corresponds to the optical wavelength characteristic of the light beams irradiated from the illuminating device 38 which is the light source.

Figure 13:
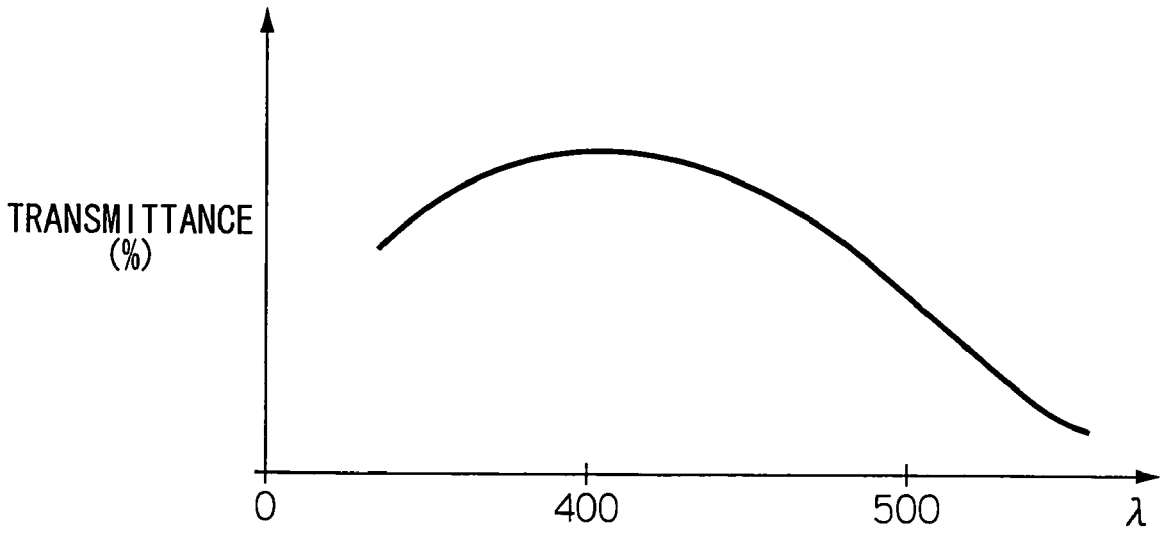
FIG. 13 is a graph for explaining operation of an optical wavelength filter of the light quantity data measuring device of the multibeam exposure device relating to the first embodiment of the present invention.

In this case, for example, in a case in which the spectral sensitivity characteristic of the photosensitive material 12 is such that the sensitivity is 50% at a wavelength of 500 μm, or in a case in which the light quantity of the light of a wavelength of 500 μm, which is included in the light beams emitted from the exposure device 38, is 50% of the total light quantity, the light quantities of the exposure beams emitted from the DMD 36 can be adjusted appropriately by adjusting the light quantities, which are received at the light-receiving element 86 of the light quantity data measurer 72, to light quantities which are effective for exposure in actuality, by using the optical wavelength filter 84 having the light transmission characteristic shown in FIG. 13.

Operation of Exposure Device

The operation of the exposure device 10, which is structured as described above, will be explained next.

Although not illustrated, at each exposure head 30 of the scanner 24, the illuminating device 38 which is a fiber array light source makes a laser beam of ultraviolet rays or the like, which is emitted from a laser light emitting element in a state of being scattered light, into parallel light by a collimator lens, and collects the light by a collecting lens. The light is made incident from an incident end surface of the core of the multimode optical fiber, and propagates through the interior of the optical fiber. At the laser emission portion, the light is multiplexed into a single laser beam, and exits from the optical fiber 40 which is coupled to the exiting end portion of the multimode optical fiber.

In the exposure device 10, image data corresponding to an exposure pattern is inputted to the controller 28 which is connected to the DMD 36, and is stored once in a memory within the controller 28. This image data is data which expresses binarily (the absence/presence of dot recording), the density of each pixel forming the image.

The stage 14, which attracts (sucks) the photosensitive material 12 to the surface thereof, is moved by an unillustrated driving device at a constant speed along the guides 20 from the conveying direction upstream side to the downstream side. When, at the time when the stage 14 passes beneath the gate 22, the leading end of the photosensitive material 12 is detected by the sensors 26 mounted to the gate 22, the image data stored in the memory is successively read-out in units of plural lines, and a control signal is generated for each exposure head 30 on the basis of the image data readout at the data processing section (CPU).

Then, by the DMD 36 driving control section of the controller 28, the respective micromirrors of the DMD 36 are controlled on and off at each of the exposure heads 30, on the basis of control signals in which the exposure quantities have been adjusted and shading adjustment has been carried out in order to make the light quantity distribution uniform.

When laser light is emitted from the illuminating device 38 to the DMD 36, the laser lights, which are reflected at the time when the micromirrors of the DMD 36 are on, form images on the exposure surface of the photosensitive material 12 by the lens system which includes the respectively corresponding microlenses 60 of the microlens array 54. In this way, the laser lights emitted from the illuminating device 38 are turned on and off per pixel, and the photosensitive material 12 is exposed in units of pixels (exposure areas) of substantially the same number as the number of pixels used at the DMD 36.

Due to the photosensitive material 12 being moved together with the stage 14 at a constant speed, the photosensitive material 12 is scanned by the scanner 24 in the direction opposite to the moving direction of the stage. The strip-shaped exposed region 34 is formed by each exposure head 30, and an image having high exposure equality is formed.

Namely, an image is formed by irradiating, onto the exposure surface of the photosensitive material 12, exposure beams which have been generated by modulation by the DMD 36 in accordance with the image which is to be exposed and formed.

When scanning of the photosensitive material 12 by the scanner 24 is completed and the trailing end of the photosensitive material 12 is detected by the sensors 26, the stage 14 is returned along the guides 20 by the unillustrated driving device to its origin which is at the most upstream side in the conveying direction, and is again moved at a constant speed along the guides 20 from the conveying direction upstream side to the downstream side.

The exposure device 10 relating to the present embodiment uses a DMD as the spatial light modulator used in the exposure head 30. However, instead of the DMD, it is possible to use, for example, a MEMS (Micro Electro Mechanical System) type spatial light modulator (SLM), or a spatial light modulator other than a MEMS type, such as a reflecting diffraction grating type grating light valve element (GLV element, manufactured by Silicon Light Machine Co.; note that details of GLV elements are disclosed in U.S. Pat. No. 5,311,360, which will be incorporated by reference herein) which is structured by a plurality of gratings being lined-up in one direction, an optical element which modulates transmitted light in accordance with the electrooptical effect (a PLZT element), a transmission-type spatial light modulator such as a liquid crystal light shutter (FLC), or the like.

Note that "MEMS" collectively refers to minute systems in which micro-sized sensors, actuators and control circuits, which are formed by micromachining techniques based on IC manufacturing processes, are integrated. A MEMS type spatial light modulator means a spatial light modulator which is driven by electromechanical operation using static electricity.

A second embodiment, which relates to a multibeam exposure device of the present invention which is structured so as to be able to measure light quantity data, will be described in accordance with FIGS. 15 and 16. Note that structural elements having structures, operations, and effects, which are similar to those in the first embodiment, are denoted by the same reference numerals, and description thereof is omitted.

Figure 15:
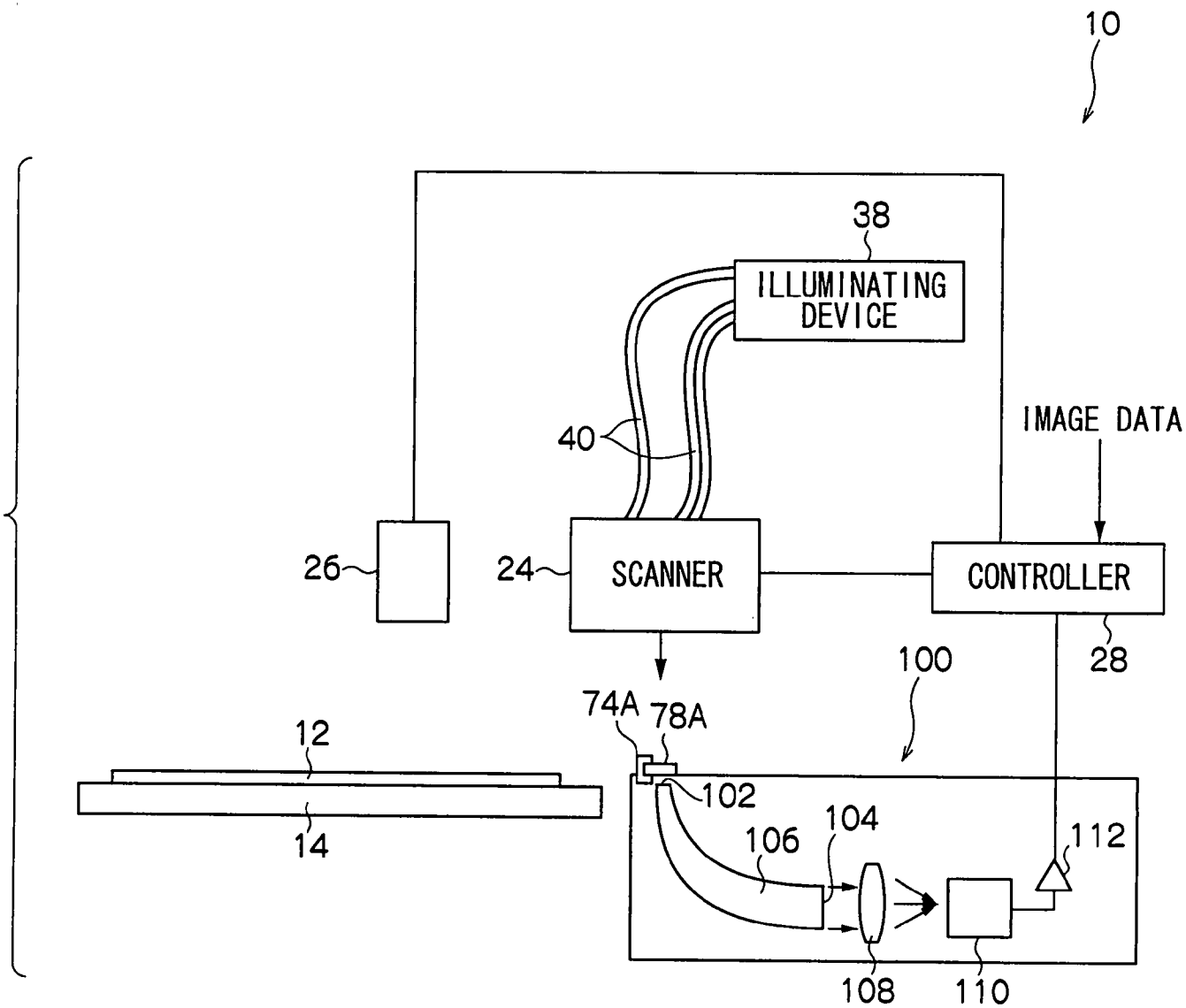
FIG. 15 is a schematic structural view showing the structure of main portions of an exposure device of a multibeam exposure device relating to a second embodiment of the present invention.

As shown in FIG. 15, the exposure device 10 has a light quantity detecting unit 100 at a predetermined position on the exposure surface, which position faces the exposure beam exit openings of respective exposure heads which are provided at the scanner 24 and are similar to those of the first embodiment.

In the scanner 24, the plural exposure heads are provided parallel to the transverse direction of the stage 14 (direction X in FIG. 1), which is orthogonal to the Y direction (the longitudinal direction of the stage 14). The scanner 24 emits multibeams, which extend in the transverse direction, as the exposure beams. Therefore, the light quantity detecting unit 100 is provided so as to extend in the transverse direction, in correspondence with the direction in which the exposure beams extend.

A light conductive sheet member 106 is provided at the light detecting unit 100. The light conductive sheet member 106 has a beam incident surface 102, which faces in a direction opposing the exposure beam exit openings of the exposure heads and extends in the direction in which the exposure beams extend, and a beam exiting surface 104, which is formed by deforming the shape of the beam incident surface 102 and such that the width thereof in the extending direction of the beam incident surface 102 is narrow.

The light conductive sheet member 106 is a member which, when the exposure beams emitted from the exposure heads are incident on the light conductive sheet member 106 from the beam incident surface 102, emits the exposure beams by displacing the exposure beams from the beam exiting surface 104 to positions corresponding to the deformed shape of the beam exiting surface 104. A structure formed as shown in FIG. 16 can be used as the light conductive sheet member 106. The light conductive sheet member 106 is structured such that the beam exiting surface 104 side portion thereof, which continues from the rectilinear beam incident surface 102, is, midway therealong, divided into three sections, and by superposing these three sections on one another, the width of the beam exiting surface 104 side is made to coincide with the configuration of the light-receiving surface of a light quantity detector 110. The number of the light quantity detectors 110, which are lined-up in accordance with the direction in which the exposure beams extend, is reduced.

An optical system 108 is provided at the light quantity detecting unit 100 so as to face the beam exiting surface 104. The light quantity detector 110 is disposed in the light quantity detecting unit 100 such that the light-receiving surface of the light quantity detector 110 is positioned at the light-collecting position of the optical system 108. The light quantity detector 110 is structured by a known photodetecting sensor which detects the light quantity of the light received at the light-receiving surface thereof, such as a PD (photodiode) or a photomultiplier or the like.

An amplifier 112, which amplifies the light quantity detection signal outputted from the light quantity detector 110, is provided in the light quantity detecting unit 100. The light quantity detection signal amplified by the amplifier 112 is sent from the light quantity detecting unit 100 to the controller 28.

A slit plate member 78A (opening plate), in which the slit 80 is formed, is disposed in the light quantity detecting unit 100 at a position on the exposure surface which is the front surface of the beam incident surface 102.

Figure 16:
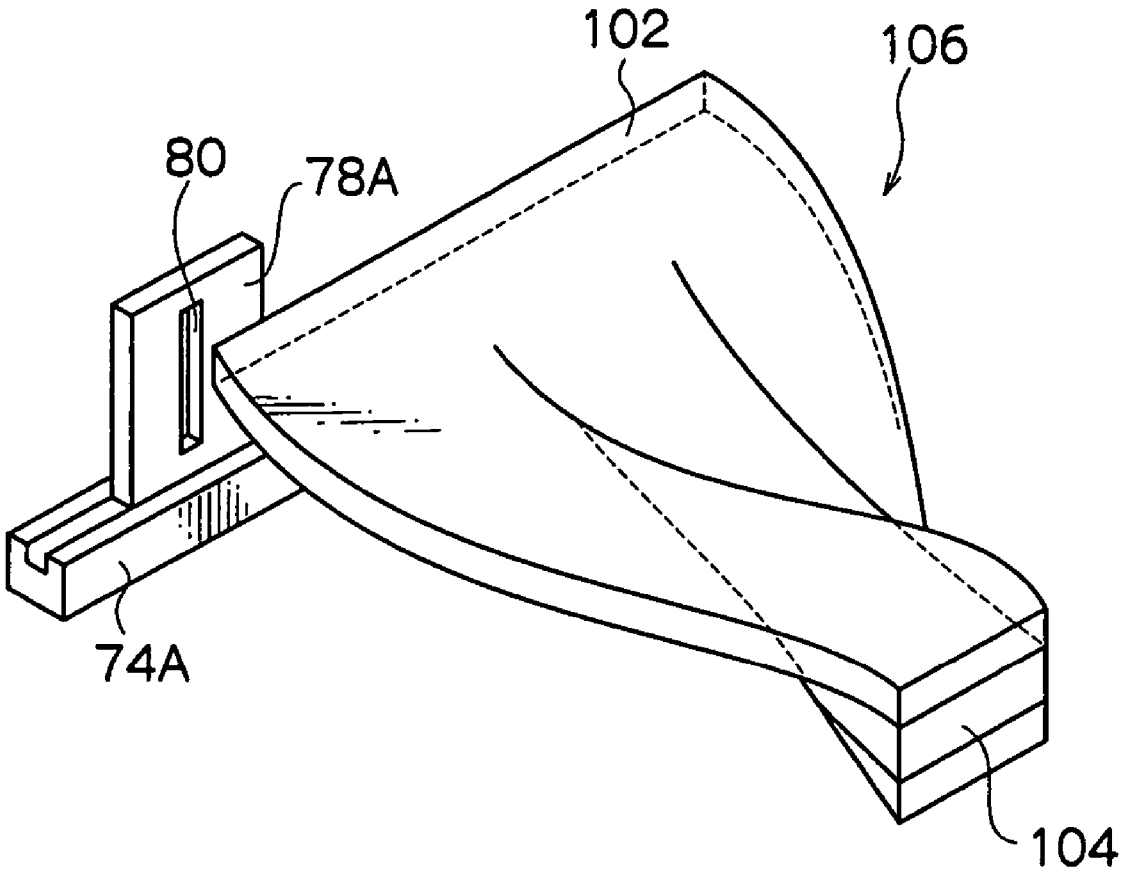
FIG. 16 is a schematic perspective view showing main portions of a light quantity detecting unit of the multibeam exposure device of FIG. 15.

As shown in FIG. 16, the slit plate member 78A is, in the same way as in the first embodiment, formed in the shape of a rectangular plate, and is disposed such that the longitudinal direction of the slit 80 is oriented in the scanning direction. The slit plate member 78A is mounted to a sliding guide groove portion of a feeding operation mechanism 74A so as to be freely movable parallel to the front of the beam incident surface 102, in a state in which the surface of the slit plate member 78A coincides with the position of the exposure surface and the longitudinal direction of the slit 80 is oriented in a direction orthogonal to the scanning direction.

The feeding operation mechanism 74A precisely feeds the slit plate member 78A by a desired feed amount in the direction orthogonal to the scanning direction of the slit plate member 78A, and is structured so as to be able to feed the slit plate member 78A at a constant, accurate feeding speed. Note that the feeding operation mechanism 74A may be structured by another, generally-used, precise feeding mechanism.

Next, description will be given of a case in which the light quantity distribution and exposure quantities are measured by the light quantity data measuring mechanism in the multibeam exposure device relating to the present second embodiment. In this case, in the same way as in the first embodiment, while control is carried out by the controller 28 to successively turn on each column of the DMD 36, which is the object of measurement at the exposure device 10, from the first column to the final column, the feeding operation mechanism 74 is controlled to be driven and the light quantity data measurer 72 is controlled to be moved such that the scan region on the exposure surface which is exposed by the group of micromirrors 46 of each column is positioned at the central portion of the slit 80. The light quantity distribution and the exposure quantities of the one DMD 36 which is the object of measurement are measured.

Note that the multibeam exposure device of the present invention is not limited to the above-described embodiments, and can assume any of various other structures within a scope encompassing the gist of the present invention.

In accordance with the multibeam exposure devices relating to the embodiments of the present invention, accurate light quantity data, such as the light quantity distribution and the like, can be measured to enable shading adjustment and exposure quantity adjustment at the time of scanning and exposing by a multibeam emitting from a spatial light modulator provided at an exposure head.

What is claimed is:

1. A multibeam exposure device carrying out exposure processing by irradiating, onto an exposure surface of a photosensitive material, an exposure beam obtained by modulating, by a spatial light modulator and in accordance with an image to be exposed and formed, a light beam which is emitted from a light source, the multibeam exposure device comprising:

an opening plate disposed on the exposure surface and blocking light which is other than an object of measurement of light quantity data at the spatial light modulator, an opening being formed in the opening plate, the opening allowing passage of the exposure beam which corresponds to a pixel which is an object of measurement of light quantity data at the spatial light modulator;

a feeding operation mechanism moving the opening plate such that the opening is moved in a direction intersecting a scanning direction at a time of scan-exposure; and a light-receiving element measuring a light quantity of the exposure beam which passes through the opening.

2. The multibeam exposure device of claim 1, wherein an optical wavelength filter is disposed on an optical path between the spatial light modulator and the light-receiving element.

3. The multibeam exposure device of claim 1, wherein a width of the opening can be changed.

4. The multibeam exposure device of claim 1, wherein a length, along the scanning direction, of the opening can be changed.

5. The multibeam exposure device of claim 1, wherein the spatial light modulator is a DMD.

6. The multibeam exposure device of claim 1, wherein the spatial light modulator is disposed such that an exposure region is inclined at a predetermined angle of inclination with respect to the scanning direction.

7. A multibeam exposure device scanning an exposure member in a given direction and forming an image on an exposure surface of the exposure member, the multibeam exposure device comprising:

a light source emitting a light beam;

an exposure head having a spatial light modulator which modulates the light beam into an exposure beam corresponding to an image to be formed, and which can selectively turn a plurality of pixels on and off;

a light quantity data measuring mechanism measuring light quantity data of the exposure beam; and a feeding operation mechanism moving the light quantity data measuring mechanism in a direction intersecting a scanning direction with respect to the exposure surface, wherein the light quantity data measuring mechanism comprising:

an opening plate disposed substantially flush with the exposure surface and blocking light which is other than an object of measurement of light quantity data at the spatial light modulator, an opening being formed in the opening plate, the opening allowing passage of the exposure beam which corresponds to a pixel which is an object of measurement of light quantity data at the spatial light modulator;

a feeding operation mechanism moving the opening plate such that the opening is moved in a direction intersecting the scanning direction at a time of scan-exposure; and a light-receiving element measuring a light quantity of the exposure beam which passes through the opening.

8. The multibeam exposure device of claim 7, wherein an optical wavelength filter is disposed on an optical path between the spatial light modulator and the light-receiving element.

9. The multibeam exposure device of claim 7, wherein a width of the opening can be changed.

10. The multibeam exposure device of claim 7, wherein a length, along the scanning direction, of the opening can be changed.

11. The multibeam exposure device of claim 7, wherein the spatial light modulator is a DMD.

12. The multibeam exposure device of claim 7, wherein the spatial light modulator is disposed such that an exposure region is inclined at a predetermined angle of inclination with respect to the scanning direction.

13. The multibeam exposure device of claim 7, wherein the opening is formed such that a length of the opening along the scanning direction is a long side of the opening.

14. The multibeam exposure device of claim 7, wherein a plurality of the exposure heads are provided.

15. The multibeam exposure device of claim 14, wherein the exposure heads are disposed such that exposure regions of the respective exposure heads partially overlap.

16. An exposure method for carrying out exposure processing by irradiating, onto an exposure surface of a photosensitive material, an exposure beam obtained by modulating, by a spatial light modulator and in accordance with an image to be exposed and formed, a light beam which is emitted from a light source, the exposure method comprising:

measuring a light quantity of the exposure beam which passes through an opening with a light-receiving element, the opening being provided in an opening plate disposed on the exposure surface and blocking light which is other than an object of measurement of light quantity data at the spatial light modulator, the opening allowing passage of the exposure beam which corresponds to a pixel which is an object of measurement of light quantity data at the spatial light modulator;

adjusting exposure quantity and/or light quantity distribution on the exposure surface on the basis of the measured light quantity data; and carrying out exposure by irradiating, onto an exposure surface of a photosensitive material, an exposure beam obtained by modulating, by a spatial light modulator and in accordance with an image to be exposed and formed, a light beam which is emitted from a light source.

17. The exposure method of claim 16, wherein an optical wavelength filter is disposed on an optical path between the spatial light modulator and the light-receiving element.

18. The exposure method of claim 17, wherein a wavelength characteristic of the optical wavelength filter is substantially coincident with a spectral sensitivity characteristic of the photosensitive material.

19. The exposure method of claim 16, wherein a width of the opening can be changed.

20. The exposure method of claim 16, wherein a length, along the scanning direction, of the opening can be changed.

21. The exposure method of claim 16, wherein the spatial light modulator is a DMD.

22. The exposure method of claim 16, wherein the measuring step includes successively lighting pixels which are objects of measurement of the light quantity data at the spatial light modulator, moving the opening plate to correspond with the pixels which are objects of measurement of the light quantity data, and measuring the light quantity of the exposure beam which passes through the opening with the light-receiving element.

23. The exposure method of claim 22, wherein an optical wavelength filter is disposed on an optical path between the spatial light modulator and the light-receiving element.

24. The exposure method of claim 23, wherein a wavelength characteristic of the optical wavelength filter is substantially coincident with a spectral sensitivity characteristic of the photosensitive material.

25. The exposure method of claim 16, wherein the measuring step includes lighting the pixel which is the object of measurement and another pixel which is not the object measurement of the light quantity data at the spatial light modulator, moving the opening plate, and measuring the light quantity of the exposure beam, which passes through the opening and which is emitted from a pixel which is an object of measurement of the light quantity data, with the light-receiving element.

26. The exposure method of claim 25, wherein an optical wavelength filter is disposed on an optical path between the spatial light modulator and the light-receiving element.

27. The exposure method of claim 26, wherein a wavelength characteristic of the optical wavelength filter is substantially coincident with a spectral sensitivity characteristic of the photosensitive material.

28. The multibeam exposure device of claim 1, wherein when the light quantity is measured, only pixels which are objects of measurement are turned on, wherein the pixels which are objects of measurement are turned on sequentially, wherein the feeding operation mechanism moves the opening plate to a position on the exposure surface which is exposed by a beam from the pixel which is the object of measurement, in accordance with turning on the pixel which is the object of measurement, and wherein the light-receiving element measures the light quantity only at said position.

29. The multibeam exposure device of claim 7, wherein when the light quantity is measured, only pixels which are objects of measurement are turned on, wherein the pixels which are objects of measurement are turned on sequentially, wherein the feeding operation mechanism moves the opening plate to a position on the exposure surface which is exposed by a beam from the pixel which is the object of measurement, in accordance with turning on the pixel which is the object of measurement, and wherein the light-receiving element measures the light quantity only at said position.

30. The exposure method of claim 16, wherein when the light quantity is measured, only pixels which are objects of measurement are turned on, wherein the pixels which are objects of measurement are turned on sequentially, wherein the opening plate is moved to a position on the exposure surface which is exposed by a beam from the pixel which is the object of measurement, in accordance with turning on the pixel which is the object of measurement, and wherein the light-receiving element measures the light quantity only at said position.

* * * * *